US010287715B2

(12) United States Patent
Lonati et al.

(10) Patent No.: US 10,287,715 B2
(45) Date of Patent: May 14, 2019

(54) CIRCULAR KNITTING MACHINE

(71) Applicant: SANTONI S.P.A., Brescia (IT)

(72) Inventors: Ettore Lonati, Botticino (IT); Fausto Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 274 days.

(21) Appl. No.: 15/117,389

(22) PCT Filed: Feb. 18, 2015

(86) PCT No.: PCT/IB2015/051237
§ 371 (c)(1),
(2) Date: Aug. 8, 2016

(87) PCT Pub. No.: WO2015/125087
PCT Pub. Date: Aug. 27, 2015

(65) Prior Publication Data

US 2016/0348287 A1 Dec. 1, 2016

(30) Foreign Application Priority Data

Feb. 24, 2014 (IT) ..... BS2014A0048

(51) Int. Cl.
*D04B 15/14* (2006.01)
*D04B 15/06* (2006.01)

(52) U.S. Cl.
CPC ..... *D04B 15/14* (2013.01); *D04B 15/06* (2013.01)

(58) Field of Classification Search
CPC ..... D04B 15/06; D04B 15/10; D04B 15/14; D04B 15/322
See application file for complete search history.

(56) References Cited

U.S. PATENT DOCUMENTS 3,643,472 A * 2/1972 Apprich ..... D04B 15/06 66/106
3,754,416 A * 8/1973 Apprich ..... D04B 9/12 66/106

(Continued)

FOREIGN PATENT DOCUMENTS

DE 703521 C 3/1941
DE 2224602 A1 1/1973

(Continued)

*Primary Examiner* — Danny Worrell
(74) *Attorney, Agent, or Firm* — Pearne & Gordon LLP

(57) ABSTRACT

A circular knitting machine (1) for knitwear or hosiery, comprising a bearing structure, a needle-bearing organ (3) and a plurality of mobile needles (N) for producing a knitted fabric; a plurality of flanked stitch-forming slots (5) is defined in an external surface (4) of the needle-bearing organ (3), each of which slots movably houses a respective needle actuable with alternating motion along the relative stitch-forming slot. The needle-bearing organ is superiorly provided with a knit-forming plane (P) destined to restingly receive portions of knitting situated between two contiguous needles (N). The machine comprises, in the zones (15) comprised between two contiguous stitch-forming slots (5), retaining organs (10) of the knitting exhibiting each a respective portion defining a stop abutment (11) for the knitting; each retaining organ (10) of the knitting being mobile on command from a first position, in which it does not interfere with the knitting being formed, to a second position, in which it inserts between two contiguous needles (N), in a zone which superiorly faces the knit-forming plane. In the zones comprised between the contiguous stitch-forming slots (5), the machine comprises lamellae (20) defining the knitting plane, each exhibiting a respective defining portion (21) of the knitting plane; each lamella (20) is removably mountable superiorly of the needle-bearing organ, so as to be coplanar with the corresponding retaining (Continued)

organ (10) located in the same zone (15), and in such a way that the respective knitting plane defining portion (21) defines a respective portion (Px) of the stitch-forming plane (P) of the needle-bearing organ (3) comprised between two contiguous stitch-forming slots (5).

20 Claims, 9 Drawing Sheets

(56) References Cited

U.S. PATENT DOCUMENTS

| | | | | | |
|---|---|---|---|---|---|
| 3,882,695 | A | | 5/1975 | Flicker | |
| 3,913,356 | A | * | 10/1975 | Suppe | D04B 9/12 66/107 |
| 4,576,018 | A | * | 3/1986 | Schindele | D04B 15/06 66/106 |
| 4,693,092 | A | * | 9/1987 | Plath | D04B 15/32 66/104 |
| 4,741,181 | A | * | 5/1988 | Plath | D04B 15/06 66/104 |
| 4,751,829 | A | * | 6/1988 | Plath | D04B 15/32 66/104 |
| 6,401,495 | B2 | * | 6/2002 | Eppler | D04B 15/06 66/106 |
| 7,895,862 | B2 | | 3/2011 | Lonati et al. | |
| 7,980,100 | B2 | | 7/2011 | Lonati et al. | |
| 8,850,853 | B2 | | 10/2014 | Lonati et al. | |
| 2009/0314038 | A1 | | 12/2009 | Lonati et al. | |
| 2010/0175428 | A1 | | 7/2010 | Lonati et al. | |
| 2013/0213093 | A1 | | 8/2013 | Lonati et al. | |

FOREIGN PATENT DOCUMENTS

| | | | |
|---|---|---|---|
| GB | 1107817 | A | 3/1968 |
| WO | 8501756 | A1 | 4/1985 |
| WO | 2008003463 | A1 | 1/2008 |
| WO | 2008145433 | A1 | 12/2008 |
| WO | 2012055591 | A1 | 5/2012 |

* cited by examiner

CIRCULAR KNITTING MACHINE

The present invention relates to a circular knitting machine. In particular, the invention relates to a circular knitting machine for knitwear and hosiery of a type not having knockover sinker plates. The present invention further relates to a needle-bearing organ for circular knitting machines and a lamella for needle bearing organs of circular knitting machines.

The present invention relates to the technical sector of circular knitting machines for knitwear, knitwear of the seamless type, hosiery and the like.

In the present text, the term "knitting machine" is intended to mean in general a circular knitting machine for to production of knitted articles and provided with a plurality of thread supply points, or "thread feeders", in which the thread is supplied to the machine needles. The knitting machine can be, for example, of the single- or double-bed type.

As is known, knitting machines, in particular with latch needles, are generally provided with organs known as knockover sinker plates, which cooperate with the needles in forming knitting.

In greater detail, the knockover sinker plates have the function of defining a knit-forming plane on which the portion of knitting situated between two contiguous needles rests while the needles, after having collected the thread at a thread guide of the machine, recess into the needle-bearing organ so as to form a new knit loop and to knock over the precedingly-formed knit loop, and also have the function of tensioning the knit loop on the stem of the needle which stem is extracted by the tip thereof and with a part of the stem thereof from the needle-bearing organ of the machine so as to collect the thread dispensed to a thread guide of the machine and form a new knit loop. During this step, the engaging of the knockover sinker plates, which determines the tensioning of the knit loop on the needle stem, also prevents the knit loop from following the needle in the extraction movement thereof and reliably obtains the opening of the latch and the passage of the loop inferiorly of the latch. The tensioning action of the knit loop on the needle stem by the knockover sinker plates is generally added-to by a pulling action of the already-formed knitting by means of pneumatic take-up devices in small-diameter circular machines and by means of mechanical devices in the other machines.

The knockover sinker plates are usually housed in special slots usually fashioned at the end of the needle-bearing organ from which the needles emerge to collect the thread at a thread feeder, directly in the needle-bearing organ or in a support element (or crown) fixed to the needle-bearing organ. The knockover plates are generally actuated by means of special cams facing the zone of the needle-bearing organ in which the knockover sinker plates are housed; the cams define pathways engageable by butts of the knockover sinker plates, which project from the needle-bearing organ, following a movement of the needle-bearing organ relatively to the cams.

From a structural point of view, in the prior art the knockover sinker plates are provided with a plane on which the knitting rests, known as the knit-forming plane, and a projecting portion, or "nose", which projects above the knit-forming plane. During the movement of the plate the nose is moved from a first position, in which it leaves space to the thread to rest on the knit-forming plane, to a second position, in which the nose advances so as to retain the stitch which, as illustrated above, tends to be dragged towards the top of the needles during the rising thereof. The knockover sinker plate, in substance, integrates the function of thread rest plane for the formation of the knitting (knit-forming plane) and the retaining of the last stitch of the knitting formed by the needles (by means of the "nose").

In many types of very high-gauge knitting machines, in which the space between the needles is extremely small, the knockover sinker plates exhibit drawbacks. Primarily, owing to the extremely high gauge configuration, the plates are necessarily very slim: this small space introduces problems of vibrations, with consequent errors in the knitting produced (for example non-homogeneous stitches). In some cases, still with reference to very high-gauge stitching machines, the knockover sinker plates are entirely absent. In fact, owing to the limited dimensions available between two adjacent forming slots, plates cannot be used as the nose and the bottom of the knit-forming plane would interfere with the knitting stitches, creating errors in the resulting knitting. In these machines, the absence of the knockover sinker plates, which is made necessary by size requirements, is the source of problems and drawbacks. In fact, the absence of the plates, on the occasion of the accidental breaking of the thread being worked, prevents an automatic resuming of the formation of the knitting and requires a manual intervention for unloading the new knit loops on the stem of the needles which, following the breaking of the thread, have dropped the stitch.

Further, owing to the fact that in these machines the tensioning action of the knit loops on the stem of the needles while the needles are extracted with the tip thereof from the needle-bearing organ to collect the thread from a thread-feeder of the machine is performed exclusively by the fabric take-up device, the tensioning can be insufficient, also due to the high number of needles engaging with the knitting, to guarantee passage of the knit loops below the latch of the needles while the needles are extracted from the needle-bearing organ, causing working errors.

To limit these problems, in some cases the machine are activated to bring, time by time, only one needle for every two contiguous needles to a thread feeder of the machine, so that the needle not utilised for forming knitting carries out a retaining action on the knit loops formed by the contiguous needles which are brought into the work position. However this solution has the drawback of not enabling full exploitation of the production potential of the machine.

To obviate the drawbacks in the prior art, which include the use of knockover sinker plates, but at the same time guarantee a correct formation of knitting stitches (in particular for very high gauge stitches), different solutions have been developed, which in substance include separating the two functions of the plate (knit-forming plane and retaining of the knitting stitch produced) and realising the two functions with two distinct elements of the knitting head. In these solutions it is the needle-bearing organ itself (for example the needle cylinder) which integrates the function of stitch-forming plane, while the retaining function is carried out by a "mobile comb" positioned externally of the cylinder. In greater detail, the needle cylinder is provided with a plurality of vertical thin plates obtained by milling of the cylinder body: each milling operation creates a recess, and two adjacent recesses define between them a thin plate. In this situation, each inter-stitch present between two adjacent needles is positioned on a respective thin plate, which defines the knitting stitch-forming plane for that inter-stitch. The mobile comb, on the other hand, comprises a plurality of mobile laminar organs mounted in a crown external of the cylinder: each mobile organ is combined with a thin plate of the body of the needle cylinder, and is able to move between a retracted position, in which it leaves space for the thread to rest on the respective thin plate (and therefore on the stitch-forming plane) and an advanced position, in which it is positioned facing the thin plate and retains the stitch just formed, preventing the stitch from being dragged upwards by the rising needles.

The above-illustrated solution, which includes dividing the two main functions of the knockover sinker plates by integrating the stitch formation directly on the needle cylinder and delegating the retaining of the stitch to the mobile comb, is the object of patent applications in the name of the present Applicant, in particular International Patent Application PCT/EP2007/005881 (published with number WO/2008/003463), PCT/EP2008/053691 (published with number WO/2008/145433) and PCT/EP2011/062895 (published with number WO/2012/055591), relating to various technical solutions regarding circular machines of the type without knockover sinker plates and with a mobile comb.

The Applicant has found that the above-described known knitting machines are not free of drawbacks and can be improved in various ways.

A drawback of the known solutions, of the type provided with a mobile comb, is represented by the fact that as it is not possible to replace the single plates (as they are not present), it is not possible to replace the knitting stitch-forming plate realized on the needle cylinder. In fact, as the stitch-forming is done directly on the needle cylinder (on the above-mentioned thin plates), while the comb performs the function of retaining the stitching, the replacement of the single thin plates is not possible and it is therefore necessary to replace the whole cylinder. This drawback is particularly significant, as the stitch-forming plane, when abrasive threads are being used and/or when the machine operates at high speeds, is subject to severe wear issues which require frequently having a new stitch-forming plane. Since, however, this replacement compulsorily relates to the entire cylinder, and is also frequently necessary, this leads to a considerable cost connected to the new needle cylinder, the necessary labour as well as the maintenance, all with the machine shut down.

Note that the above solution using knockover sinker plates enables the replacement of the single plates; but it was not usable for working with very high gauge stitches.

In general, known knitting machines:

- require complex and/or expensive mounting and maintenance operations;
- are not able to keep up performance levels, in terms of quality and/or resistance to vibrations and/or uniformity of the fabric produced, when working with very high gauge stitching;
- exhibit limitations in terms of performance when used with abrasive threads and, in general, when used continuatively for long periods of time and/or at high speeds.

In this situation, the aim underpinning the present invention, in the various aspects and/or embodiments thereof, is to disclose a circular knitting machine which can obviate one or more of the cited drawbacks.

A further aim of the invention is to disclose a knitting machine, of a type without knockover sinker plates and with a mobile comb, able to afford easy replacement of the knitting stitch forming plane.

A further aim of the present invention is to disclose a knitting machine able to simplify and/or make less expensive the maintenance operations, in particular in relation to the maintenance required for solving the problems connected to the wear on the knit-forming plane.

A further aim of the present invention is to disclose a knitting machine able to operate efficiently at every gauge, and in particular including high-gauge, for example in the order of 40 or 60 or 80 needles per inch.

A further aim of the present invention is to disclose a knitting machine able to operate efficiently also with highly-abrasive threads and/or able to operate continuatively at high speeds.

A further aim of the present invention is to disclose a knitting machine that requires assembly and/or maintenance operations that are simple and rapid, in particular with respect to the prior art.

A further aim of the present invention is to disclose a knitting machine characterised by a high degree of functioning reliability and/or by a lower predisposition to faults and malfunctioning.

A further aim of the present invention is to disclose a knitting machine characterised by an ease of the maintenance operations required.

A further aim of the present invention is to disclose a knitting machine, of a type without knockover sinker plates and with a mobile comb, characterised by an original structure that is alternative and novel with respect to the known solutions.

A further aim of the present invention is to disclose a knitting machine characterised by a simple and rational structure.

A further aim of the present invention is to disclose a knitting machine able to produce knitted articles characterised by high quality and/or uniformity, in particular with respect to the known knitting machines.

A further aim of the present invention is to disclose a knitting machine having improved performance, in particular able to improve the quality and/or increase the productivity, for example in terms of quantity of knitting produced per unit of time and/or complexity of the knitting produced.

A further aim of the present invention is to disclose a knitting machine characterised by a modest manufacturing cost with respect to the performances and quality offered.

These aims and others besides, which will more fully emerge during the course of the following description, are substantially attained by a circular knitting machine, and/or by a needle-bearing organ for circular knitting machines, and/or by a lamella for needle-bearing organs of circular knitting machines, according to one or more of the appended claims, each of which taken along (without the respective dependencies) or in any combination with the other claims, as well as according to the following aspects and/or embodiments, variously combined, also with the following claims.

In a first aspect, the invention relates to a circular knitting machine for knitwear or hosiery, comprising:

- a bearing structure;
- at least a needle-bearing organ or needle cylinder rotatably mounted in the bearing structure;
- a plurality of needles supported by the needle-bearing organ and mobile so as to produce a knitted fabric;

wherein a plurality of flanked stitch-forming slots is defined in an external surface of the needle-bearing organ, each of which slots being open at least at a respective upper end and configured so as to movably house at least a portion of a respective needle actuable with alternating motion along the stitch-forming slot with an extracting motion, by means of which the needle is extracted with the tip thereof and with a portion of a stem thereof superiorly from the needle-bearing organ through the upper end of the relative stitch-forming slot in order to operate an unloading, on the stem thereof, of a knit loop previously formed and/or to operate a collecting of the thread or the threads dispensed at a thread feeder of the machine, and with a return motion, by means of which the needle is returned with the tip thereof into the relative stitch-forming slot so as to form a new knit loop, actuating the knockover of the knit loop previously formed in order to produce a knitting stitch. In an aspect, the needle-bearing organ is superiorly provided with a knit-forming plane destined to restingly receive portions of knitting situated between two contiguous needles while the needles, after having collected the thread at a thread feeder of the machine, return into the respective stitch-forming slots of the needle-bearing organ in order to form a new knit loop and to knock over the previously-formed knit loop, the stitch-forming slots being superiorly open on a side of the needle-bearing organ where the knit-forming plane is defined.

In an aspect the machine comprises, in at least a part of the zones of the needle-bearing organ comprised between two contiguous stitch-forming slots, treatment organs of the knitting exhibiting each a respective portion defining a stop abutment for the knitting, each retaining organ of the knitting being mobile on command from a first position, in which it does not interfere with the knitting being formed, to a second position, in which it inserts, with the portion defining the stop abutment, between two contiguous needles, in a zone which superiorly faces the knit-forming plane, so as to retain the portion of knitting extending between two contiguous needles and oppose the dragging of the knitting along the needles during the extracting motion thereof.

In an aspect the machine comprises, for each of the retaining organs of the knitting, respective actuating means for commanding passage thereof between the first position and the second position in a coordinated way with the actuating of the contiguous needles.

In an aspect the machine comprises, at least in the zones comprised between the contiguous stitch-forming slots provided with the retaining organ, lamellae defining the knitting plane each exhibiting a respective defining portion of the knitting plane. In an aspect, each lamella is removably mountable to the needle-bearing organ, in such a way as to be positioned, in the zone between two contiguous stitch-forming slots, substantially coplanar to the corresponding retaining organ located in the same zone, and in such a way that the respective defining portion of the knitting plane defines a respective portion of the knit-forming plane of the needle-bearing organ comprised between the two contiguous stitch-forming slots.

In an aspect, each lamella is removably positionable superiorly of the needle-bearing organ, in such a way as to be, in the zone between two contiguous stitch-forming slots, substantially coplanar to the corresponding retaining organ located in the zone, and in such a way that the respective defining portion of the knitting plane defines a respective portion of the knit-forming plane of the needle-bearing organ comprised between the two contiguous stitch-forming slots.

In an aspect each lamella is removably mountable to a crown external of the needle-bearing organ and solidly constrained thereto, so as to be positioned superiorly to the needle-bearing organ and coplanar to the corresponding retaining organ located in the same zone, and in such a way that the respective defining portion of the knitting plane defines a respective portion of the knit-forming plane of the needle-bearing organ comprised between the two contiguous stitch-forming slots.

In an aspect each lamella is singly removably mountable to the needle-bearing organ.

In an aspect, the needle-bearing organ comprises a plurality of stitch-forming slot half-planes and a plurality of guide half-planes, distributed about the needle-bearing organ and alternated with one another, in which each stitch-forming slot and the respective needle lie on a respective stitch-forming slot half-plane, and in which each zone of the needle-bearing organ comprised between two contiguous stitch-forming slots, the respective retaining organ and the respective lamella lie on a respective guide half-plane.

In an aspect each lamella is provided with a holding portion, configured so as to be externally facing the external surface of the needle-bearing organ in a respective zone between two adjacent stitch-forming slots. In an aspect each retaining organ is provided with a front side, facing towards the external surface of the needle-bearing organ, and a rear side, destined to be operatively associated to the respective actuating means, and is positioned so that the front side is facing the respective lamella, and the lamella is radially interposed, at least with the holding portion thereof, between the external surface of the needle-bearing organ and the retaining organ.

In an aspect each retaining organ comprises, at a front edge thereof, a maintaining portion laterally interposed between two contiguous stitch-forming slots and configured so as to maintain in position the respective lamella mounted to the needle-bearing organ, preventing the lamella from translating, in particular radially, distancingly from the needle-bearing organ and thus being able to decouple therefrom.

In an aspect the maintaining portion of the retaining organ is configured so as to be maintained in contact with the respective lamella mounted to the needle-bearing organ or at a predetermined constant distance from the lamella, both when the retaining organ is in the first position and when it is in the second position, and in the passage between the first and the second position, and/or in each operating condition of the knitting machine, with lamellae and retaining organs in mounted condition.

In an aspect each of the lamellae defining the knitting plane exhibits a respective mounting portion, configured and predisposed to enable single and removable mounting of the lamella to the needle-bearing organ. In an aspect, for each lamella the defining portion of the knitting plane is interposed between and connects the mounting portion and the holding portion.

In an aspect the defining portion of the knitting plane is positioned between the mounting portion and the holding portion in such a way that the respective portion of the knit-forming plane, defined by the lamella, is in a top position in the lamella and is positioned, in the needle-bearing organ, at a vertical height that is greater than the stitch-forming slots adjacent to the lamella.

In an aspect, the knit-forming plane of the needle-bearing organ is defined exclusively by the knitting plane defining portions of the lamellae.

In an aspect, the knit-forming plane of the needle-bearing organ comprises a circular succession of portions of knit-forming plane that are identical to one another, each being defined by a single lamella, and alternated with empty spaces at which the needles are extracted. In an aspect the knit-forming plane is defined by the enveloping of the defining portions of the knitting plane by the lamellae. In an aspect the mounting portion has a hook conformation, and is configured so as to enable the mounting of the lamella to the needle-bearing organ by mechanical hooking. In an aspect the mounting portion is configured so as to enable mounting the lamella to the needle-bearing organ without any need for gluing.

In an aspect the mounting portion of the lamella terminates with a mounting end configured so as to be at least partially complementarily-shaped to a mounting seating of the needle-bearing organ, wherein the inserting of the mounting element in the mounting seating prevents distancing of the lamella from the needle-bearing organ. In an aspect the mounting seating of the needle-bearing organ is made as a recess or stop abutment on a top or internal surface of the needle-bearing organ.

In an aspect the mounting seating of the needle-bearing organ is made by a single machining operation, preferably a single lathing, and extends circumferentially along the whole needle-bearing organ, the holding seating being one alone for the mounting portions of all the lamellae removably mountable to the needle-bearing organ.

In an aspect the mounting portion is provided with a mounting protuberance distinct from the mounting end and profiled so that the mounting protuberance and the mounting end define between them a mounting recess, the recess being complementarily-shaped with respect to a portion of a top surface of the needle-bearing organ, such that—in the mounted configuration—the mounting recess superiorly surrounds the top surface portion of the needle-bearing organ, the mounting end being at least partially on an internal side of the needle-bearing organ and the mounting protuberance being at least partially headed on the external surface of the needle-bearing organ.

In an aspect the holding portion of the lamella terminates with a holding end configured so as to insert, in the mounting of the lamella to the needle-bearing organ, internally of a holding seating of the needle-bearing organ, realized on an external surface of the needle-bearing organ, in which the inserting of the holding end in the holding seating enables or contributes to the mounting of the lamella to the needle-bearing organ.

In an aspect the holding seating of the needle-bearing organ is realised as a recess or stop abutment on an external surface of the needle-bearing organ.

In an aspect the holding seating of the needle-bearing organ is realized with a single machining, preferably a single lathing, and extends circumferentially along the whole needle-bearing organ, the holding seating being one alone for the holding portions of all the lamellae removably mountable to the needle-bearing organ.

In an aspect the inserting of the mounting end in the mounting seating and the inserting of the holding end into the holding seating determine the removable mounting of the lamella to the needle-bearing organ.

In an aspect, each lamella is configured so as to assume a fixed and single mounted position with respect to the needle-bearing organ.

In an aspect the holding portion of the lamella exhibits a determined elasticity with respect to the knitting plane defining portion, and is configured so as to elastically deform during the mounting step, so that, following the inserting of the mounting end in the mounting seating of the needle-bearing organ, the inserting of the holding end into the holding seating is achieved by a snap-movement and the mounting of the lamella to the needle-bearing organ is removable only by applying a necessary demounting force such as to cause a counter-deformation of the holding portion which causes the decoupling of the lamella from the needle-bearing organ.

In an aspect the holding end of the lamella comprises a holding foot insertable in the holding seating recessing from the external surface of the needle-bearing organ, the holding foot emerging from the remaining part of the holding portion of the lamella by at least 0.5 mm, and in a radial nearing direction to the rotation axis of the needle-bearing organ.

In an aspect the lamella is conformed such that the inserting of the mounting end in the mounting seating and the inserting of the holding end in the holding seating is achieved by means of an elastic deformation of the lamella, in particular of the holding portion thereof, such as to determine a snap-mounting of the lamella to the needle-bearing organ.

In an aspect the lamella is conformed in such a way as to define a spring operating between a rest configuration, in which the mounting portion and the holding portion exhibit a reciprocal distance, and at least a stressed configuration, in which the holding portion and the mounting portion are distanced from one another, increasing the reciprocal distance, the distancing generating a closing force tending to return the spring into the rest configuration.

In an aspect the mounting protuberation, cooperating with the mounting end so as to define the mounting recess, is configured so as to maintain the respective lamella in the mounted position, once it has been mounted to the needle-bearing organ and the respective holding foot is inserted in the holding seating of the needle-bearing organ, and/or is configured so as to perform an anti-rotation function of the lamella when it is mounted to the needle-bearing organ.

In an aspect the knitting machine comprises retaining means configured such as to maintain one or more lamellae in the mounted position to the needle-bearing organ, preventing the lamella from translating distancingly from the needle-bearing organ and decoupling therefrom.

In an aspect, the retaining means are positioned substantially in contact with the one or more lamellae mounted to the needle-bearing organ, in such a way as to prevent any movement of the lamellae distancingly from the needle-bearing organ, and preventing demounting of the lamellae from the needle-bearing organ.

In an aspect retaining means are positioned in contact with the one or more lamellae mounted to the needle-bearing organ and externally thereof.

In an aspect at least a lamella exhibits, on a rear side opposite the needle-bearing organ, a recessed seating for resting or inserting the filiform element.

In an aspect the recessed seating is comprised in the holding portion.

In an aspect the recessed seating is positioned, in the respective lamella, in such a way as to be facing towards the outside of the needle-bearing organ, with the lamella mounted.

In an aspect, in the holding portion of the respective lamella, the recessed seating develops in an opposite direction to the holding foot, configured so as to insert in the holding seating of the needle-bearing organ.

In an aspect all the lamellae are provided with a respective recessed seating, and the filiform element is configured so as to engage all the recessed seatings, so as to maintain all the lamellae in the mounted position to the needle-bearing organ.

In an alternative aspect, the retaining means comprise a fixed cam, positioned externally of the needle-bearing organ, associated to an angular sector of the needle-bearing organ and engaging, during the rotation of the needle-bearing organ, with the side of one or more lamellae in rotation facing on an opposite side with respect to the needle-bearing organ.

In an aspect the fixed cam is dimensioned and configured so as to face an angular sector of the needle-bearing organ and engage, during the rotation of the needle-bearing organ, a plurality of adjacent lamellae comprised, instant by instant, in the angular sector. In an aspect the retaining means comprise a plurality of fixed cams, distributed angularly externally of the needle-bearing organ and each configured so as to face a respective angular sector of the needle-bearing organ and engage, instant by instant, a respective plurality (or group) of lamellae.

In an aspect each retaining organ is oscillatable, by means of the respective actuating means, in the guide half-plane thereof so as to pass from the first position to the second position and vice versa.

In an aspect, the maintaining portion is in an intermediate position in the retaining organ, and defines an oscillation axis of the retaining organ relative to the needle-bearing organ, the oscillation axis being orientated substantially perpendicularly to the guide half-plane in which the retaining organ of the knitting lies, the retaining organ of the knitting being oscillatable about the oscillating axis relatively to the needle-bearing organ so as to pass from the first position to the second position or vice versa.

In an aspect the maintaining portion of the retaining organ has a curved profile, preferably an arc of circle, on the front side of the retaining organ, in such a way as to be maintained at a constant distance from the lamella during the oscillation which determines passage from the first position to the second position and vice versa.

In an aspect the portion defining the stop abutment is positioned at an upper end of the retaining organ, the upper end projecting beyond the knit-forming plane and develops in the direction of the needle-bearing organ so as to define, with the side thereof facing towards the knit-forming plane, the stop abutment.

In an aspect, the actuating means of the retaining organ of the knitting for passage thereof from the first position to the second position and vice versa comprise at least an actuating cam facing the external face of the needle-bearing organ.

In an aspect, at least a retaining organ is solidly connected, in proximity of the rear side thereof, to at least a contiguous retaining organ, the two connected retaining organs straddling the knitting formation slot positioned between the two guide half-planes on which the two retaining organs lie.

In an aspect the retaining organs realise, overall, a comb, wherein each retaining organ is an element of the comb interposed between two adjacent stitch-forming slots, so as to retain the interstitch present between the two adjacent needles operating in the two stitch-forming slots, i.e. for retaining the thread interposed between and inserted in two adjacent needles.

In an aspect the comb is positioned externally of the needle-bearing organ.

In an aspect the circular knitting machine is of a type not equipped with knockover sinker plates.

In an aspect the needles of the machine are of the type having a latch.

In an aspect the needle-bearing organ can be a needle cylinder or a needle plate.

In an aspect the circular knitting machine of the single-bed or double-bed type.

In an aspect the needles supported by the needle-bearing organs are mobile parallel to a rotation axis of the needle-bearing organ for producing a knitted fabric.

In an aspect each of the stitch-forming slots has a longitudinal development that is parallel to the rotation axis of the needle-bearing organ.

In an aspect the stitch-forming slots develop at least at an upper annular portion of the external surface of the needle-bearing organ.

In an aspect each stitch-forming slot movably houses a respective needle during the extraction motion and the return motion.

In a further aspect, each stitch-forming slot extends longitudinally in such a way as to laterally contain, substantially over a whole length thereof, the respective needle housed therein.

In an alternative aspect, a plurality of flanked sliding slots is further defined on the external surface of the needle-bearing organ, and located inferiorly of and separated from the stitch-forming slots.

In an aspect the sliding slots develop at an intermediate annular portion of the external surface of the needle-bearing organ, distinct from the upper portion and distanced from the upper end of the needle-bearing organ where the knitting plane is defined.

In an aspect each sliding slot develops inferiorly of a respective pair of stitch-forming slots.

In an aspect each sliding slot is configured such as to movably house a respective pair of adjacent needles, which are slidably flanked internally of the sliding slot.

In an aspect the sliding slot is configured such that the two adjacent needles contained therein are each combined to a respective stitch-forming slot of the pair of stitch-forming slots overlying the sliding slot combined therewith.

In substance, if only stitch-forming slots are present, which extend substantially over the whole length of the needle, each stitch-forming slot houses one respective needle only. If on the other hand sliding slots are present, the stitch-forming slot extends only in an upper portion of the external surface of the needle-bearing organ; for each sliding slot two stitch-forming slots are present.

In an independent aspect, the present invention relates to a lamella defining the knitting plane for needle-bearing organs, circular knitting machines, the lamella comprising a knitting plane defining portion and being configured so as to be removably mountable superiorly of the needle-bearing organ, in such a way as to be positioned in the zone comprised between the contiguous stitch-forming slots of the needle-bearing organ, and in such a way that the knitting plane defining portion defines a respective portion of a stitch-forming plane of the needle-bearing organ between the two contiguous stitch-forming slots.

In an aspect the lamella is configured such as to be removably mountable to the needle-bearing organ in such a way as to be positioned substantially coplanarly to a corresponding stitch-retaining organ located in the same zone comprised between two contiguous stitch-forming slots, in which the retaining organ exhibits a respective portion defining a stop abutment for the knitting and is mobile on command from a first position, in which it does not interfere with the stitch under formation, to a second position, in which it inserts, with the portion defining the abutment, between two contiguous needles, in a zone which superiorly faces the knit-forming plane, in order to retain the portion of knitting extending between two contiguous needles, opposing the dragging of the knitting along the needles during the extracting motion thereof.

In an aspect each lamella is provided with a holding portion, configured so as to be externally facing the external surface of the needle-bearing organ in a respective zone between two adjacent stitch-forming slots.

In an aspect the lamella is configured to be maintained mounted to the needle-bearing organ by means of the respective retaining organ.

In an aspect the lamella, when mounted to the needle-bearing organ, is configured so as to be externally substantially in contact with a maintaining portion of the respective retaining organ.

In an aspect the lamella defining the knitting plane exhibits a mounting portion, configured and predisposed for enabling single and removable mounting of the lamella to the needle-bearing organ.

In an aspect, in the lamella the knitting plane defining portion is interposed between, and connects, the mounting portion and the holding portion.

In an aspect the mounting portion and the holding portion of the lamella each have a respective longitudinal development and extend from the knitting plane defining portion according to two distinct directions.

In an aspect the two distinct directions form between them an angle of less than a flat angle, preferably less than a right-angle.

In an aspect the knitting plane is positioned between the mounting portion and the holding portion in such a way that the respective portion of the knit-forming plane, defined by the lamella, is in a top position in the lamella and is positioned, in the needle-bearing organ, at a vertical height that is greater than the stitch-forming slots adjacent to the lamella.

In an aspect the mounting portion has a hook conformation and is configured such as to enable the mounting of the lamella to the needle-bearing organ by means of a mechanical engagement.

In an aspect the mounting portion of the lamella terminates with a mounting end configured so as to be at least partially complementarily-shaped to a mounting seating of the needle-bearing organ, in which the inserting of the mounting end into the mounting seating prevents distancing of the lamella from the needle-bearing organ.

In an aspect the mounting portion is provided with a mounting protuberance distinct from the mounting end and profiled so that the mounting protuberance and the mounting end define between them a mounting recess, the recess being complementarily-shaped with respect to a portion of a top surface of the needle-bearing organ, such that—in the mounted configuration—the mounting recess superiorly surrounds the top surface portion of the needle-bearing organ, the mounting end being at least partially on an internal side of the needle-bearing organ and the mounting protuberance being at least partially headed on the external surface of the needle-bearing organ.

In an aspect the holding portion of the lamella terminates with a holding end configured so as to insert, in mounting the lamella to the needle-bearing organ, internally of a holding seating of the needle-bearing organ, realised on the external surface of the needle bearing organ, wherein the inserting of the holding end in the holding seating determines or contributes to the mounting of the lamella to the needle-bearing organ.

In an aspect, the lamella is configured so as to assume a fixed and single mounted position with respect to the needle-bearing organ.

In an aspect the holding portion of the lamella exhibits a determined elasticity with respect to the knitting plane defining portion, and is configured so as to elastically deform during the mounting step, so that, following the to inserting of the mounting end in the mounting seating of the needle-bearing organ, the inserting of the holding end into the holding seating is achieved by a snap-movement and the mounting of the lamella to the needle-bearing organ is removable only by applying a necessary demounting force such as to cause a counter-deformation of the holding portion which causes the decoupling of the lamella from the needle-bearing organ.

In an aspect the holding end of the lamella comprises a holding foot configured for being insertable in the holding seating recessing from the external surface of the needle-bearing organ, the holding foot emerging by at least 0.5 mm from the remaining part of the holding portion of the lamella, and in a radial nearing direction to the rotation axis of the needle-bearing organ.

In an aspect the lamella is conformed in such a way that the inserting of the mounting end in the mounting seating and the inserting of the holding end into the holding seating is achieved by means of an elastic deformation of the lamella, in particular of the holding portion, such as to determine the snap-mounting of the lamella to the needle-bearing organ.

In an aspect the mounting portion and the holding portion are, when the lamella is separated from the needle-bearing organ, reciprocally positioned to one another, and the mounting of the lamella requires an elastic deformation which leads to a distancing of the holding portion from the mounting portion up to complete inserting of the mounting end in the mounting seating and the holding end of the holding seating.

In an aspect the lamella is conformed such as to define a spring operating between a rest configuration, in which the mounting portion and the holding portion exhibit a reciprocal distance, and at least a stressed configuration, in which the holding portion and the mounting portion are distanced from one another, increasing the reciprocal distance, the distancing generating a closing force tending to return the spring into the rest configuration.

In an aspect, the lamella is configured so as to assume the rest position when it is separated from the needle-bearing organ and when it is mounted to the needle-bearing organ, and so as to temporarily assume the stressed configuration when it is pressed on the needle-bearing organ so as to force snap-insertion of the mounting end in the mounting seating and the holding end in the holding seating.

In a possible embodiment, the lamella is configured so as to assume the rest position when it is separated from the needle-bearing organ, so as to temporarily assume a rest configuration when it is separated from the needle-bearing organ, so as to temporarily assume a stressed configuration when it is pressed to the needle-bearing organ so as to force the snap insertion of the mounting end of the mounting seating and the holding end in the holding seating, and so as to maintain a residual deformation when the snap-insertion has brought the lamella into the mounted configuration to the needle-bearing organ, the residual deformation generating a preload able to maintain the lamella (mounted) pressingly on the needle-bearing organ.

In an aspect the lamella has an overall hook-shape, i.e. it embraces the upper end of the needle-bearing organ, in the space between two adjacent stitch-forming slots, with the mounting portion and the holding portion, superiorly positioning the knitting plane defining portion.

In an aspect the lamella is configured so as to be coupled to the needle-bearing organ in the rest configuration, by means of an initial inserting of the mounting end into the mounting seating, so as subsequently to assume the stressed configuration, by elastic deformation of the holding portion, which is temporarily bent externally of the needle-bearing organ, and so as to return into the rest position when mounting is completed, by means of snap-insertion of the holding end into the holding seating and return of the holding position into contact with the external surface of the needle-bearing organ.

In an aspect the lamella is configured so as to enable coupling from above of the mounting recess, defined by the mounting end and the mounting protuberance, to the top surface of the needle-bearing organ, and subsequently a sliding downwards of the whole lamella, such as to cause the temporary deformation of the holding portion externally of the needle-bearing organ, up to when the holding end reaches the holding seating, with a consequent recuperation of the temporary deformation and a heading of the holding portion on the external surface of the needle-bearing organ.

In a further aspect, each lamella and the respective rod, lying on a same guide half-plane, are solidly constrained to one another, and are preferably made in a single piece. In an aspect the single lamella-rod element defines both a respective portion of the knit-forming plane and a respective flank of a stitch-forming slot, housing a respective needle.

In an aspect the lamella comprises one or more technical characteristics described in one or more of the above aspects.

In an independent aspect, the present invention relates to a needle-bearing organ for a circular knitting machine, rotatably mountable in a bearing structure of the knitting machine and configured so as to support a plurality of needles mobile so as to produce a knitted fabric, the needle-bearing organ being provided with an external surface on which a plurality of flanked stitch-forming slots is defined, each of the slots being open at least at an upper end thereof and configured so as to movably house at least a portion of a respective actuable needle having alternating motion along the relative stitch-forming slot with an extracting motion, by means of which the needle is extracted with the tip thereof and with a portion of the stem thereof superiorly from the needle-bearing organ through the upper end of the relative stitch-forming slot, to as to operate the unloading, on its stem, of the knit loop previously formed and/or to operate the collecting of the thread or threads dispensed at a thread feeder of the machine, and with a return motion, by means of which the needle is returned with the tip thereof into the relative stitch-forming slot so as to form a new knit loop, actuating the knockover of the previously-formed loop so as to produce knitting, the needle-bearing organ being provided with at least a defining lamella of the knitting plane comprising a defining portion of the knitting plane and removably mountable superiorly of the needle-bearing organ, in such a way as to be positioned in the zone comprised between two contiguous stitch-forming slots of the needle-bearing organ, and in such a way that the defining portion of the knitting plane defines a respective portion of a knit-forming plane of the needle-bearing organ comprised between the two contiguous stitch-forming slot.

In an aspect the needle-bearing organ comprises one or more lamellae according to any one of the above aspects and/or the claims.

Each of the above-cited aspects of the invention can be taken alone or in combination with any one of the claims or other described aspects.

Further characteristics and advantages will more fully emerge from the detailed description of some embodiments, among which also a preferred embodiment, by way of non-exclusive example, of a circular knitting machine according to the present invention, and a lamella for needle-bearing organs of circular knitting machines according to the present invention. This description will be made with reference to the accompanying figures, provided by way of non-limiting and therefore non-limiting example, with reference to the accompanying drawings, provided by way of non-limiting example, in which:

FIG. 1 schematically illustrates, in a perspective view, a portion of a possible embodiment of a circular knitting machine according to the present invention, with some parts removed for the sake of clarity; in particular the figure illustrates a portion of the needle-bearing organ of the knitting machine, a plurality of stich-forming slots, a plurality of lamellae, a needle by way of example and a retaining organ represented in a second position;

Figure 15:
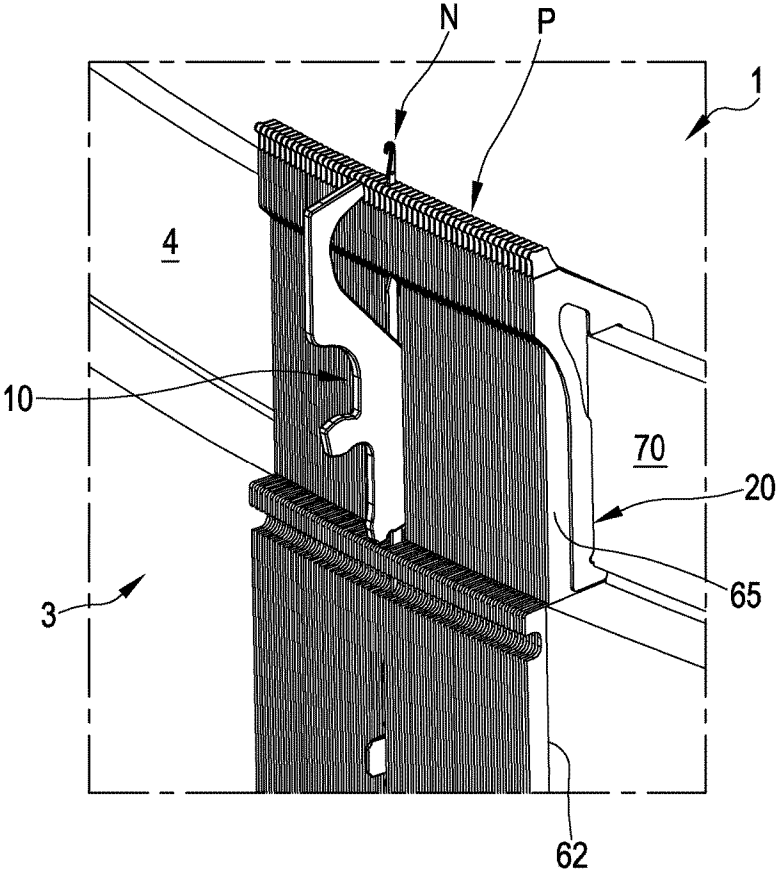
Figure 14:
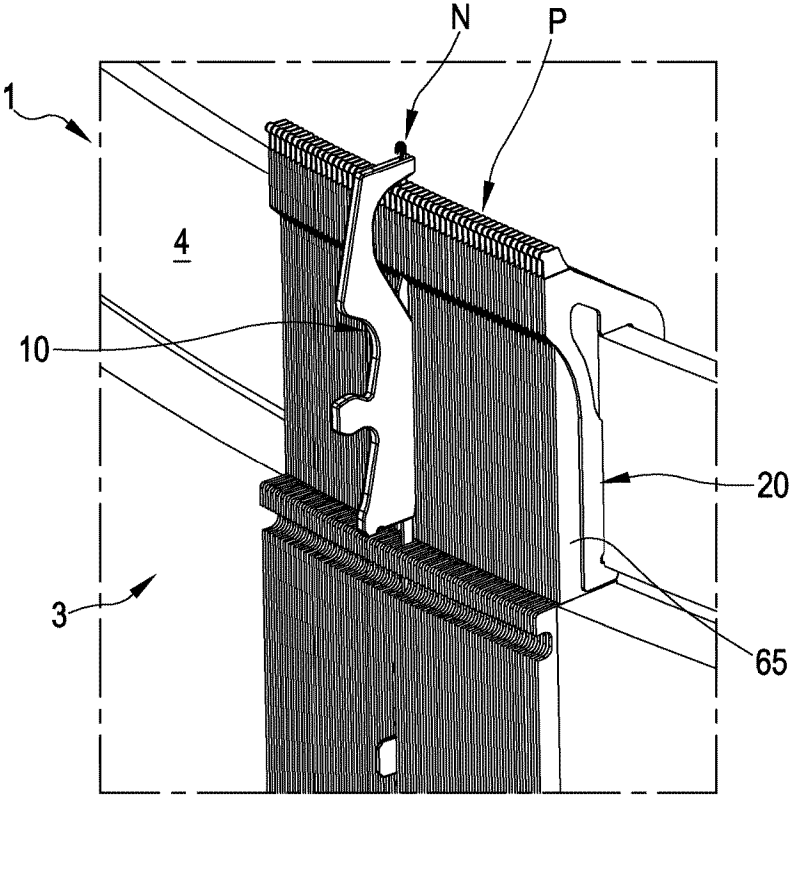
Figure 18:
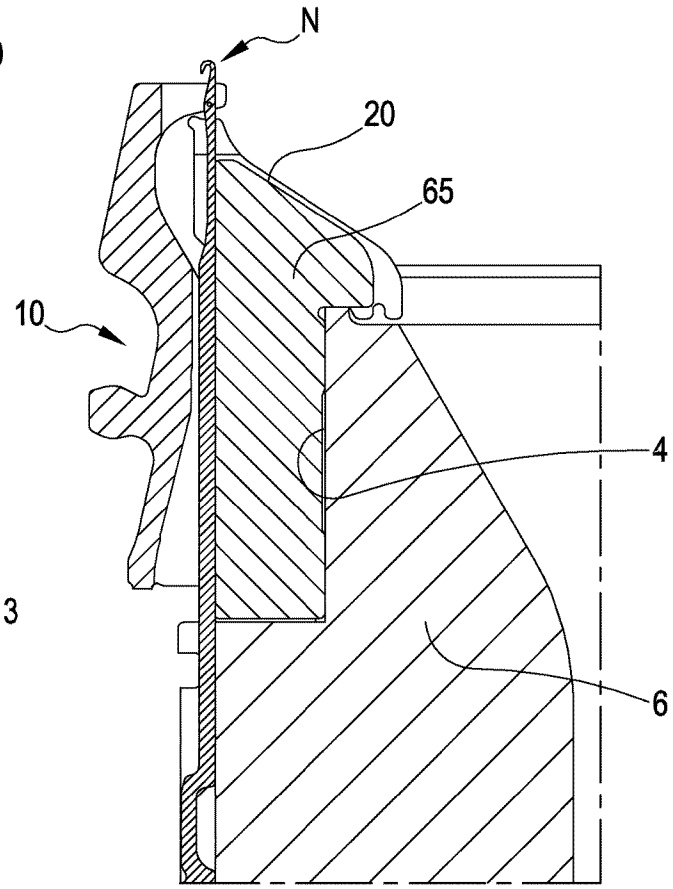
Figure 17:
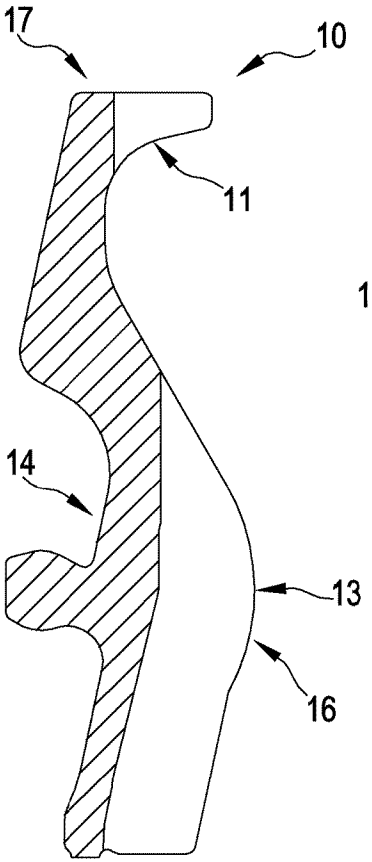
Figure 16:
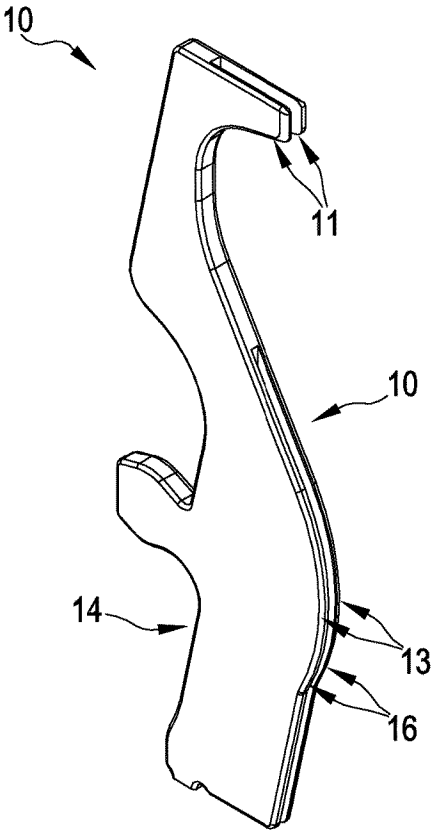

FIG. 14 schematically illustrates, in a perspective view, a portion of a further embodiment of a circular knitting machine according to the present invention, with some parts removed for the sake of clarity; the figure illustrates in particular a portion of the needle-bearing organ of the knitting machine, a plurality of stitch-forming slots, a plurality of lamellae, a needle (by way of example), and a retaining organ of the double type, represented in a second position;

FIG. 15 is a perspective schematic view of the portion of circular knitting machine of FIG. 14, with the retaining organ of the double type represented in a first position;

FIG. 16 is a perspective view of a further embodiment of a retaining organ according to the present invention, of the double type;

FIG. 17 is a frontal view of the retaining organ of FIG. 16, sectioned along a median longitudinal plane;

FIG. 18 is a section view of a portion of the knitting machine of FIG. 14, with a double retaining organ, sectioned along a vertical plane coinciding with a half-plane of stitch-forming slot and passing through a stitch-forming slot, through the needle movably housed internally thereof and for a median portion of the double retaining organ.

With reference to the figures, reference numeral 1 denotes in its entirety a circular knitting machine according to the present invention. In general, the same reference numeral is used for identical or like elements, possibly in the variant embodiments thereof.

Figure 1:
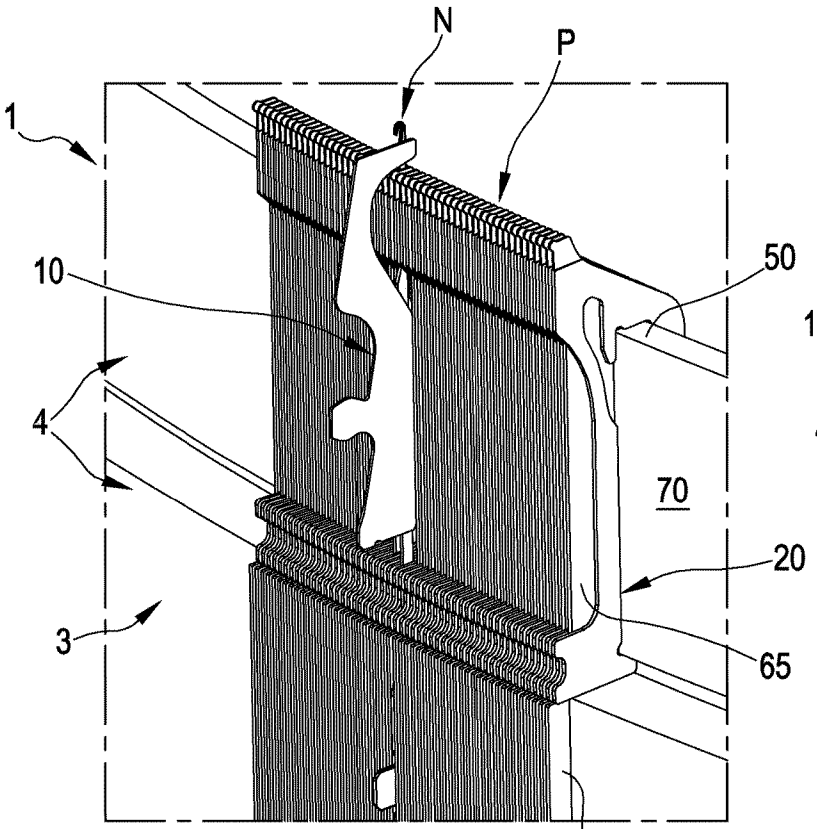
Figure 3:
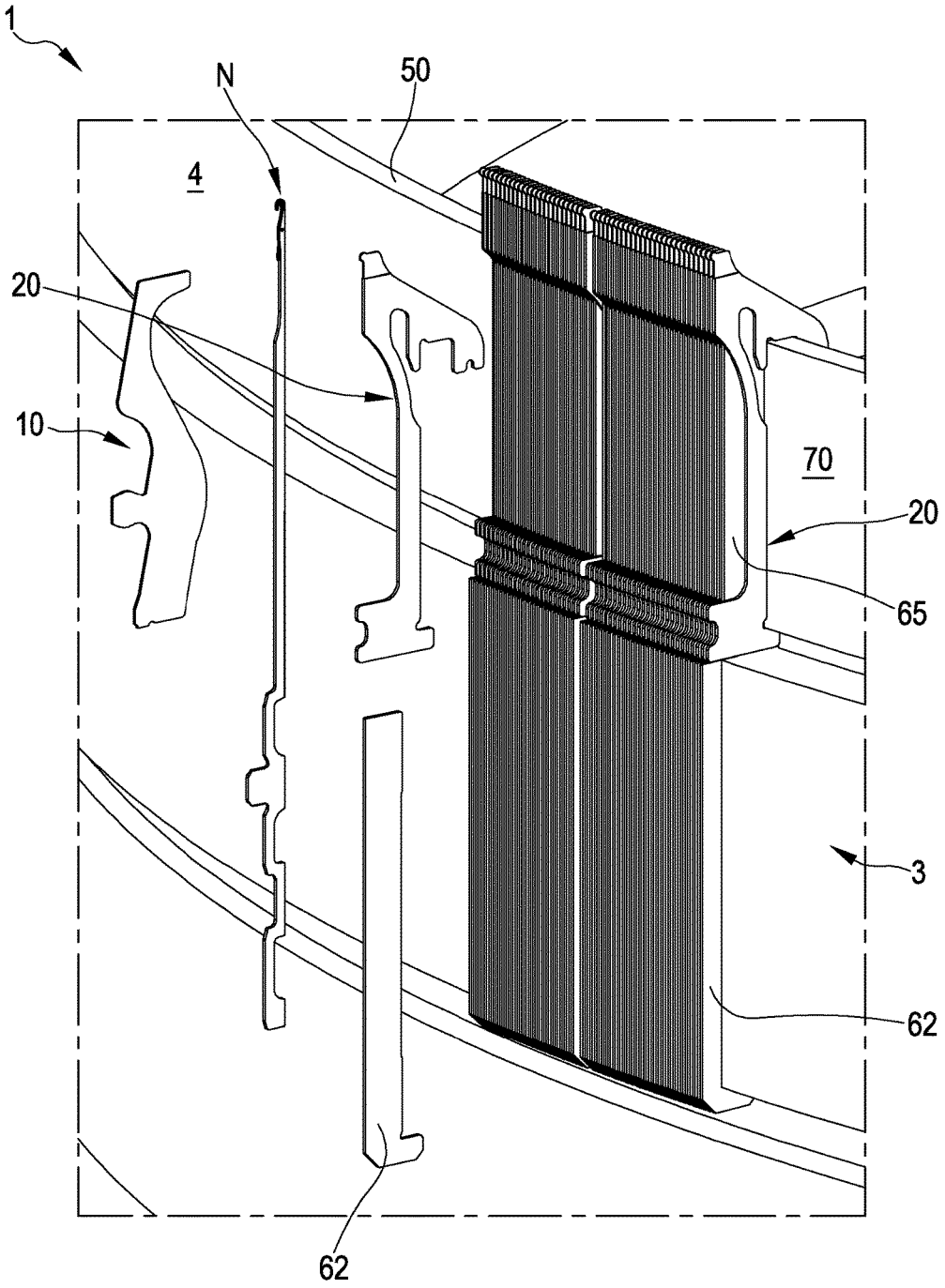
FIG. 3 is a schematic perspective illustration, partially exploded, of the portion of circular knitting machine of FIG. 1; in particular a retaining organ is shown in exploded view, a needle, a lamella and a rod of the needle-bearing organ.

FIG. 1 shows a portion of a possible embodiment of a circular knitting machine, for knitwear or seamless knitwear or for hosiery, according to the present invention, with some parts removed. In particular, the illustration of the machine is focalized on a portion of the needle-bearing portion (in this case by way of example a needle cylinder) in such a way as to enable comprehension of the present invention.

The base of the knitting machine, the section comprising the processing unit, the devices typically present in the knitting head and other parts of the knitting machine are not shown in detail in the figures, as they are of known and conventional type. From a point of view of the knitting technology, the functioning of the whole knitting machine (for example the functioning of the knitting head, the cooperation between needles and threads, etc.) is not described in detail, also being known in the technical sector of the present invention.

The knitting machine 1 primarily comprises a bearing structure, at least a needle-bearing organ 3 or needle cylinder rotatably mounted to the bearing structure and a plurality of needles N supported by the needle-bearing organ and mobile for producing a knitted fabric.

In the figures the needle-bearing organ is a needle cylinder and can exhibit a diameter that is variable according to knitting requirements; for example the diameter can be comprised between 4 inches and 60 inches. The needle-bearing organ can be, equivalently, a needle plate.

The knitting machine further comprises a plurality of thread feeding points, or thread feeders (not illustrated) in which the thread is supplied to the needles of the machine. The thread feeders are positioned circumferentially about the needle-bearing organ and distanced angularly from one another, preferably in a uniform way. The knitting machine can comprise a variable number of thread feeders, for example 2, 4, 6, 8, 10, 12, 16 or more.

As visible in the portions of needle-bearing organ shown in the figures, a plurality of stitch-forming slots 5 is defined on an external surface 4 of the needle-bearing organ 3: each of these slots is open at least at a respective upper end and is configured such as to movably accommodate at least a portion of a respective needle N. Each needle is actuated with a reciprocating motion along the corresponding stitch-forming slot 5 with an extraction motion, by means of which the needle is extracted with its tip and a portion of the stem thereof, superiorly from the organ needle-bearing organ through the upper end of stitch-forming slot so as to operate the unloading, onto the stem thereof, the previously-formed knit loop and/or to operate the collection of the thread or threads provided in at a thread feeder of the machine, and with a return motion, by which the needle is returned with the tip thereof in the corresponding stitch-forming slot so as to form a new knit loop by lowering the previously-formed knit loop to produce knitting.

The needle-bearing organ 3 is superiorly provided with a knit-forming plane P destined to receive and support the portions of knitting located between two contiguous needles N while the needles N, after collecting the thread at a thread feeder of the machine, return within the respective stitch-forming slot 5 to form a new knit loop and to knock over the previously-formed knit loop. The stitch-forming slots 5 are superiorly open on the side of the needle-bearing organ where the knit-forming plane P is defined.

Figure 2:
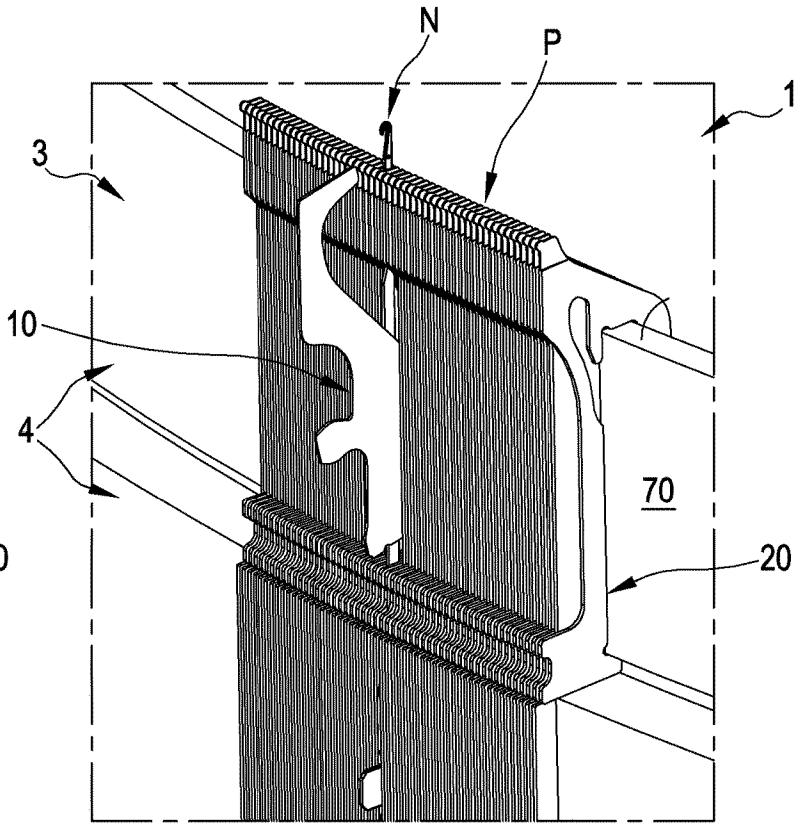
FIG. 2 is a schematic perspective view of the portion of the circular knitting machine of FIG. 1, with the retaining organ represented in a first position.

The machine comprises, in at least a part of the zones 15 of the needle-bearing organ comprised between two contiguous stitch-forming slots 5, retaining organs 10 of the knitting, each having a respective portion defining a stop abutment 11 for the knitting. Each retaining organ 10 is movable on command from a first position (shown by way of example in FIGS. 2, 6 and 15), in which it does not interfere with the knitting under formation, to a second position (shown by way of example in FIGS. 1, 5, 14 and 18), in which is inserted, with the portion defining the abutment 11, between two contiguous needles N, in a zone that faces superiorly of the knit-forming plane P, so as to retain the portion of the knitting extending between two contiguous needles, opposing the dragging of the knitting along the needles during the extraction motion thereof.

The knitting machine comprises, for each of the retaining organs 10, respective actuating means (not shown, being, for example, of known type) to command the passage between the first position and the second position in a coordinated manner with the actuation of the contiguous needles. In other words, the relative movements between the retaining body and the contiguous needles is synchronized mechanically, by the actuating means.

The knitting machine 1 also comprises, at least in the zones 15 comprised between the contiguous stitch-forking slots 5 provided with retaining organs 10, lamellae 20 defining the knitting plane each exhibiting a respective defining portion of the knitting plane 21.

Each lamella is removably mountable superiorly to the needle-bearing organ 3, in such a way as to be positioned, in the zone 15 between two contiguous slots 5, substantially coplanar to the corresponding retaining organ 10 located in the same zone 15, and in such a way that the respective defining portion 21 of to the knitting plane defines a respective portion Px of the knit-forming plane P between the two contiguous stitch-forming slots 5.

Each lamella 20 is preferably individually removably mounted superiorly to the needle-bearing organ 3.

Each retaining organ 10 is preferably combined with a respective lamella 20 to form a retaining organ—lamella pair associated to a respective zone 15 of the needle-bearing organ comprised between two adjacent stitch-forming slots 5.

The retaining organ 10 and the lamella 20 preferably exhibit a thin plate conformation.

The needle-bearing organ 3 preferably comprises a plurality of half-planes of the stitch-forming slot A and a plurality of guide half-planes B, distributed around the needle-bearing organ and mutually alternated, in which each stitch-forming slot 5 and the respective needle N lie on a respective half-plane A of a stitch-forming slot, and in which each zone 15 of the needle-bearing organ 3 comprised between two contiguous stitch-forming slots, the respective retaining organ 10 and the respective lamella 20 lie on a respective guide half-plane B. In other words, as shown by way of example in the figures, each of the half-planes A of a stitch-forming slot vertically crosses a respective stitch-forming slot 5 and a respective needle N, and each of the guide half-planes B vertically crosses a respective zone of the needle-bearing organ 15 between two contiguous stitch-forming slots, a respective retaining organ 10 and a respective lamella 20 defining the knitting plane.

Preferably the half-planes of stitch-forming slot A and B guide half-planes all pass through the axis of rotation of the needle-bearing organ 3 and are distributed radially around this axis.

The retaining organ 10 and the respective thin plate 20 are preferably arranged, on the respective guide half-plane B, parallel to the sides of the stitch-forming slot 5 between which they are arranged.

Preferably each lamella 20 is provided with a holding portion 30, configured to be externally facing the external surface 4 of the needle-bearing organ 3 in a respective zone 15 between two adjacent stitch-forming slots.

Each retaining organ 10 is preferably provided with a front side 13, facing towards the external surface 4 of the needle-bearing organ, and a rear side 14, intended to be operatively associated to the respective actuating means (not shown). The retaining organ is positioned in such a way that the front side 13 is facing the respective lamella 20, and the lamella is radially interposed, at least with the holding portion 30 thereof, between the external surface 4 of the needle-bearing organ 3 and the retaining organ.

Each retaining organ 10 preferably comprises, at a front side 13 thereof, a maintaining portion 16 laterally interposed between two contiguous stitch-forming slots 5 and configured so as to maintain in position the respective lamella 20 mounted on the needle-bearing organ 3, preventing the lamella from translating, in particular radially, distancingly from the needle-bearing organ and uncoupling therefrom.

Figure 5:
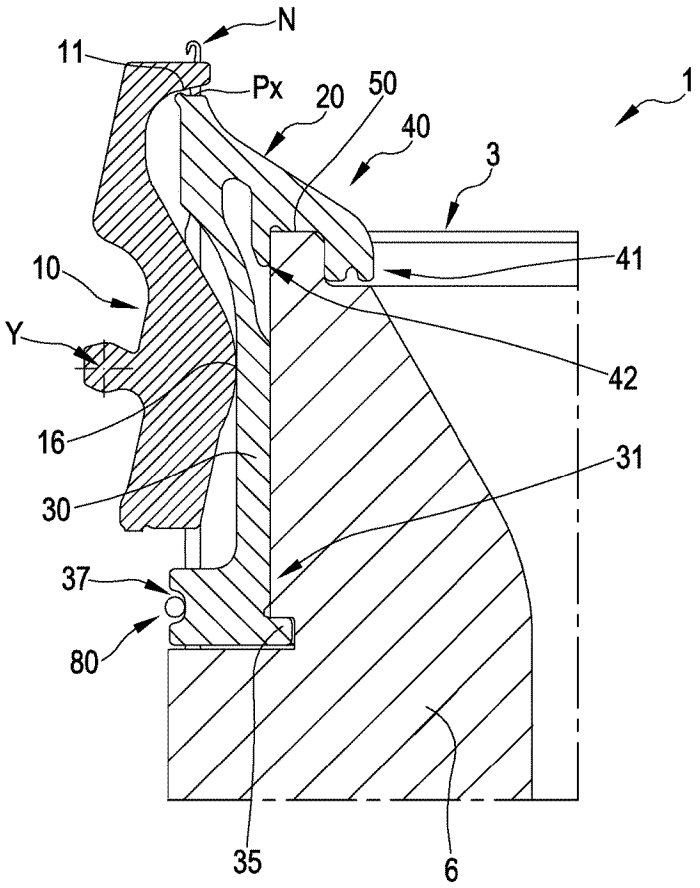
FIG. 5 is a further section view of a portion of the knitting machine of FIG. 1, sectioned along a further vertical plane (indicated by B), coinciding with a guide half-plane and then passing through a retaining organ (illustrated in the second position) and through a lamella defining the knitting plane.
Figure 4:
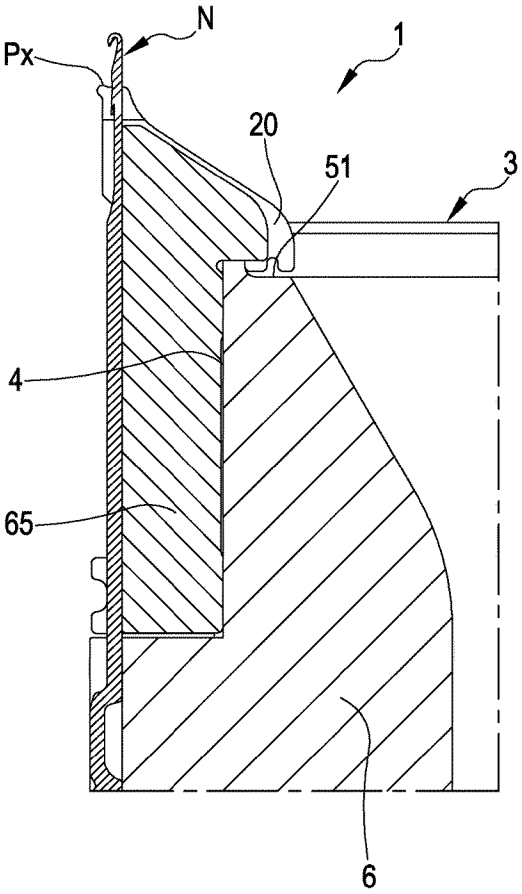
FIG. 4 is a section view of a portion of the knitting machine of FIG. 1, sectioned along a vertical plane (indicated by A) coinciding with a half-plane of stitch-forming slot and then passing through a stitch-forming slot and though the needle movably housed internally thereof.
Figure 6:
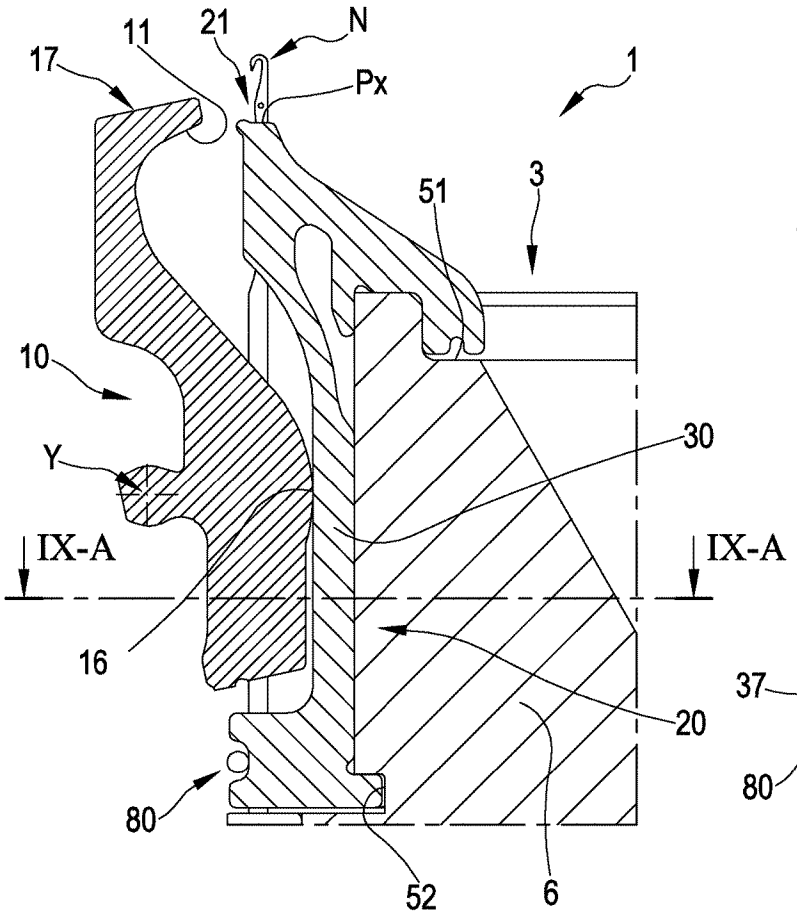
FIG. 6 is alike FIG. 5, with the difference that the retaining organ is illustrated in the first position.

The maintaining portion 16 is preferably positioned substantially in contact with the respective lamella 20 mounted to the needle-bearing organ (as shown in FIGS. 5 and 6) or at a distance from the lamella, mounted to the needle-bearing organ, such as to interfere with a possible movement of the lamella distancingly from the needle-bearing organ, and to avoid demounting the lamella of the needle-bearing organ.

Each lamella 20 is preferably maintained mounted to the needle-bearing organ 3 by means of the respective retaining organ 10, in particular by means of the maintaining portion 16 of the respective retaining organ.

In a possible embodiment, the maintaining portion 16 is positioned substantially in contact with the respective lamella 20 mounted to the needle-bearing organ so as to press on it, with the machine in use, with a holding force such as to prevent every movement of the lamella in a distancing direction from the needle-bearing organ, and to avoid the demounting of the lamella therefrom.

The maintaining portion 16 of the retaining organ is preferably positioned substantially in contact with the holding portion 30 of the respective lamella.

The maintaining portion 16 of the retaining organ 10 is preferably configured so as to remain in contact with the respective lamella mounted to the needle-bearing organ, or at a certain determined distance from the respective lamella, both when the retaining organ 10 is located in the first position (FIG. 6), and when it is in the second position (FIG. 5), as well as during the passage between the first and the second positions. In general, the maintaining portion is preferably configured so as to remain in contact with the respective lamella in each operating condition of the knitting machine, with lamellae and retaining organs in the mounted condition.

Each of the defining lamellae 20 of the knitting plane preferably has a respective mounting portion 40, which enables individual and removable mounting of the lamella to the needle-bearing organ 3.

Preferably, as shown by way of example in the figures, for each lamella 20 the portion defining the knitting plane 21 is interposed between, and connects, the mounting portion 40 and the holding portion 30. The mounting portion 40 and the holding portion 30 of the lamella 20 each preferably have a respective longitudinal development and extend from the defining portion of the knitting plane in two distinct directions.

These two distinct directions preferably form between them an angle that is smaller than a flat angle, more preferably smaller than a right angle.

The defining portion 21 of the knitting plane is preferably positioned between the mounting portion 40 and the holding portion 30 so that the respective portion Px of the knit-forming plane P, defined by the lamella 20, is in the topmost position in the lamella and is positioned, in the needle-bearing organ 3, at a vertical height about the stitch-forming slots 5 adjacent to the lamella.

The knit-forming plane P of the needle-bearing organ 3 is therefore preferably defined exclusively by defining portions Px of knitting plane of all the lamellae.

The knit-forming plane P of the needle-bearing organ 3 preferably comprises a circular succession of Px portions of knit-forming plane equal to one another, each defined by a single lamella 20, and alternated with empty spaces at which the extraction of the needles N is performed; this condition is illustrated by way of example in FIGS. 1, 2, 8, 14 and 15.

The knit-forming plane is preferably defined by the enveloping of the defining portions Px of knitting plane by the lamellae 20. The portions Px of the knit-forming plane preferably lie substantially in a single plane.

The mounting portion 40 preferably has a hook shape, and is configured so as to enable mounting the lamella 20 to the needle-bearing organ 3 by means of mechanical coupling. The mounting portion is preferably configured so as to enable mounting the lamella to the needle-bearing organ without the need for gluing.

The mounting portion 40 of the lamella 20 preferably terminates with a mounting end 41 configured to be at least partially complementarily-shaped to a mounting seating 51 of the needle-bearing organ; the insertion of the mounting end in the seating prevents the distancing of the lamella from the needle-bearing organ.

The mounting seating 51 of the needle-bearing organ is preferably designed as a recess or stop abutment on a top surface 50 or the internal surface of the needle-bearing organ 3. The mounting seating 51 of the needle-bearing organ is preferably made in a single machining operation, preferably a single lathing, and extends circumferentially along the entire needle-bearing organ 3; the sealing seating is one alone for the mounting portions 40 of all the lamellae 20 which are removably mountable to the needle-bearing organ.

The needle-bearing organ preferably exhibits a top surface 50, at which of the above-mentioned mounting seat 51 is realised, having a lower height than the height at which the portions Px of knit-forming plane P defined by the lamellae 20 are positioned; the defining portions Px of the knitting plane of the lamellae are, with the lamellae mounted, located above the top surface 50 of the needle-bearing organ.

The mounting portion 40 is preferably provided with a mounting protuberance 42 distinct from the mounting end 41 and shaped in such a way that the protuberance and the mounting end define between them a mounting recess 43. The recess 43 is complementarily-shaped to a portion of the top surface 50 of the needle-bearing organ 3, in such a way that—in the mounted configuration—the mounting recess 43 superiorly surrounds the upper portion of the top surface of the needle-bearing organ. In this way, the mounting end 41 is at least partly on an internal side of the needle-bearing organ, while the mounting protuberance 42 is headed at least partially on the external surface 4 of the needle-bearing organ 3.

The mounting protuberance 42, cooperating with the mounting end 41 to define the mounting recess 43, is preferably configured so as to prevent unwanted rotations of the respective lamella 20, when mounted to the needle-bearing organ, and/or to prevent the release of the respective lamella of the needle-bearing organ.

The mounting protuberance 42 preferably extends from the mounting portion 40 in a substantially parallel direction to the development of the holding end 31.

The holding portion 30 of the lamella preferably terminates with a holding end 31 configured so as to insert, during the mounting of the lamella 20 to the needle-bearing organ, internally of a holding seating 52 of the needle-bearing organ 3, made on the external surface 4 of the needle-bearing organ itself. The insertion of the holding end 31 in the holding seating 52 contributes to the mounting of the lamella 20 to the needle-bearing organ 3.

The seal seating 52 of the needle-bearing organ is preferably designed as a recess or stop abutment on an external surface of the needle-bearing organ.

The seal seating 52 is preferably realized with a single machining operation, preferably a single lathing, and extends circumferentially along the entire needle-bearing organ. In this situation, the holding seating 52 is one alone for the holding portions 30 of all the lamellae 20 removably mountable to the needle-bearing organ.

As in the embodiment shown by way of example in the figures, the insertion of the mounting end 41 in the mounting seating 51 and the insertion of the holding end 31 in the holding seating 52 preferably determine the removable mounting of the lamella 20 to the needle-bearing organ.

Each lamella 20 is preferably configured so as to assume a mounted position that is fixed and one only with respect to the needle-bearing organ.

The holding portion 30 of the lamella preferably exhibits a certain elasticity with respect to the defining portion 21 of the knitting plane, and is configured so as to deform elastically during the mounting step, in such a way that—following the insertion of the mounting end 41 in the mounting seating 51 of the needle-bearing organ—the insertion of the holding end 31 in the holding seating 52 is achieved by a snap-motion, and the mounting of the lamella 20 to the needle-bearing organ 3 is removable only by applying a necessary demounting force such as to cause a counter-deformation of the holding portion which causes the uncoupling of the lamella from the needle-bearing organ.

The holding end 31 of the lamella 20 preferably includes a holding foot 35 insertable into the holding seating 52 recessed from the external surface 4 of the needle-bearing organ. The holding foot 35 preferably emerges by at least 0.5 mm from the remaining part of the holding portion 30 of the lamella, and in a radial direction towards the rotation axis of the needle-bearing organ.

The mounting seating 51, formed on the top or the internal surface 50 of the needle-bearing organ, and the holding seating 52, formed on the external surface 4 of the needle-bearing organ 3, are preferably orientated so that the mounting portion 40 and the holding portion 30 embrace the needle-bearing organ 3 with forces that cooperate to maintain the lamella in the mounting configuration to the needle-bearing organ.

The lamella 20 is preferably shaped such that the insertion of the mounting end 41 in the mounting seating 51 and the insertion of the holding end 31 in the holding seating 52 is achieved by means of an elastic deformation of the lamella, in particular of the holding portion 30, such as to determine a snap-mounting of the lamella to the needle-bearing organ.

When the lamella 20 is separated from organ needle-bearing organ, the mounting portion 40 and the holding portion 30 are preferably mutually positioned (e.g. partially facing one another) and the mounting of the lamella requires an elastic deformation that involves a distancing of the holding portion 30 of the mounting portion 40 up to the complete insertion of the assembly 41 in the mounting seating 51 and the holding end 31 in the holding seating 52.

The lamella 20 is preferably conformed so as to define a spring operating between a rest configuration, in which the mounting portion and the holding portion are mutually distanced, and at least a stressed configuration, in which the holding portion and the mounting portion are distanced from one another, the distancing generating a closing force tending to return the spring into the rest configuration.

The lamella 20 is preferably configured so as to assume the rest position when it is separated from the needle-bearing organ and is mounted to the needle-bearing organ, and to temporarily assume the stressed configuration when pressed to the needle-bearing organ to force the snap-insertion of the mounting end in the mounting seating assembly and the holding end in the holding seating.

The lamella 20 preferably has an overall hook shape, i.e. embracing an upper end of the needle-bearing organ, in the space between two adjacent stitch-forming slots 5, with the mounting portion 40 and the holding portion 30, superiorly positioning the portion 21 defining the knitting plane.

The lamella is preferably configured so as to be coupled to the needle-bearing organ in the rest configuration, by means of an initial insertion of the mounting fitting 41 into the mounting seating 51, so as subsequently to assume the above stressed configuration, by elastic deformation of the holding portion 30, which is temporarily bent externally of the needle-bearing organ, and to return to the rest configuration after mounting is completed, by means of snap-insertion of the holding end 31 (in particular of the holding foot 35) in the holding seating 52 and the return of the holding portion into contact with the external surface 4 of the needle-bearing organ.

The lamella 20 is preferably configured so as to enable coupling of the mounting recess 43 from above, which recess 43 is defined by the mounting end and the mounting protuberance, to the top surface 50 of the needle-bearing organ 50, and subsequently a downwards sliding of the whole lamella 20, such as to cause temporary deformation of the holding portion externally of the needle-bearing organ, up to when the holding end reaches the holding seating, with a consequent recuperation of the above-mentioned temporary deformation and heading of the holding portion on the external surface of the needle-bearing organ.

The mounting protuberance 42, cooperating with the mounting end 41 to define the mounting recess 43, is preferably configured so as to maintain the respective lamella in the mounted position, once it has been mounted to the needle-bearing organ, and the respective holding foot is inserted into the holding seating of the needle-bearing organ. Further, the mounting protuberance 42 is configured to perform an anti-rotation function with respect to the lamella when the needle-bearing organ is mounted.

In an embodiment, the knitting machine preferably includes retaining means 80 configured so as to maintain one or more lamellae in the mounted position to the needle-bearing organ, preventing the lamella from translating in a distancing direction from the needle-bearing organ and decoupling therefrom.

The retaining means 80 are preferably positioned substantially in contact with one or more lamellae mounted to the needle-bearing organ, in such a way as to prevent any movement of the lamellae in the organ distancingly from the needle-bearing organ, and to prevent decoupling of the lamellae from the needle-bearing organ.

The retaining means 80 are preferably positioned in contact with one or more lamellae mounted to the needle-bearing organ and externally thereof.

Preferably the retaining means are active posteriorly on the respective holding portions of the one or more lamellae.

Figure 7:
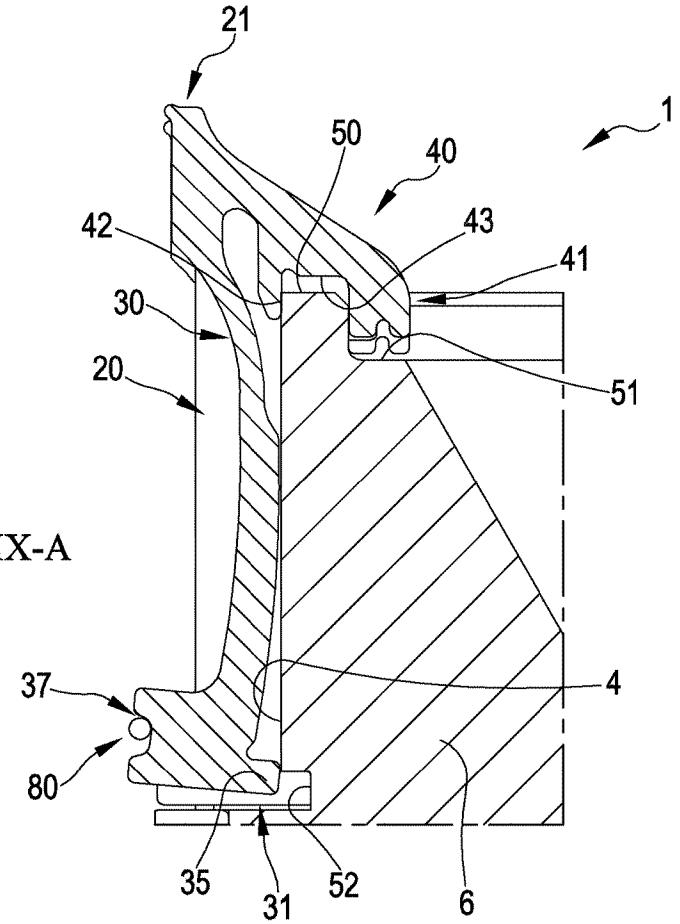
FIG. 7 is a further section view of a portion of the knitting machine of FIG. 1, sectioned along a vertical plane (indicated by B) coinciding with a guide half-plane; the figure shows a lamella during mounting to the needle-bearing organ (in particular the lamella is illustrated in the stressed configuration)

The retaining means 80 are schematically illustrated in FIGS. 5, 6 and 7.

The retaining means 80 can comprise a filiform element, preferably elastically extensible, associated to the one or more lamellae and engaging with the side of the one or more lamellae facing the opposite side to the needle-bearing organ (in practice on the rear side of the holding portions of the lamellae). At least one lamella 20 preferably exhibits, on a rear side thereof opposite the needle-bearing organ 3, a recessed seating 37 for the support or insertion of the filiform element. The recessed seating 37 is preferably comprised in the holding portion 30.

The recessed seating 37 is preferably positioned in the respective lamella 20 in such a way, with the lamella mounted to the needle-bearing organ, as to be facing externally of the needle-bearing organ.

In the holding portion of the respective lamella, the recessed seating 37 preferably develops in an opposite direction to the holding foot 35, configured so as to insert into the holding seating 52 of the needle-bearing organ 3.

All of the lamellae are preferably provided with a respective recessed seating 37, and the filiform element is configured such as to engage all the recessed seatings, in order to keep all the lamellae in the mounted position to the needle-bearing organ.

The filiform element is preferably configured so as to be solidly constrained to the lamellae and the needle-bearing organ, and to rotate solidly with the needle-bearing organ. The thread-like element can be a helical spring.

In an alternative aspect, the retaining means can comprise a fixed cam, positioned externally of the needle-bearing organ, associated to an angular sector of the needle-bearing organ and engaging, during the rotation of the needle-bearing organ, with the side of the one or more lamellae in rotation facing the opposite side with respect to the needle-bearing organ.

The fixed cam can preferably engage the recessed seating of one or more lamellae in rotation. The fixed cam is preferably dimensioned and configured such as to face an angular sector of the needle-bearing organ and engage, during the rotation of the needle-bearing organ, a plurality of adjacent lamellae included, instant by instant, in an angular sector of the needle-bearing organ. The retaining means preferably comprise a plurality of fixed cams, angularly distributed externally of the needle-bearing organ and each configured to face a respective angular sector of the needle-bearing organ and engage, instant by instant, a respective plurality (or group) of lamellae. In essence, the fixed cams are arranged externally of the needle-bearing organ, while the lamellae rotate solidly therewith: instant by instant, the lamellae which are facing a fixed cam are engaged thereby and retained in the mounted position on the needle-bearing organ. The engagement of the fixed cam to each lamella is achieved by means of the respective recessed seating. During a complete rotation of the needle-bearing organ, each fixed cam engages, in succession, all the lamellae mounted to the needle-bearing organ.

Figure 11:
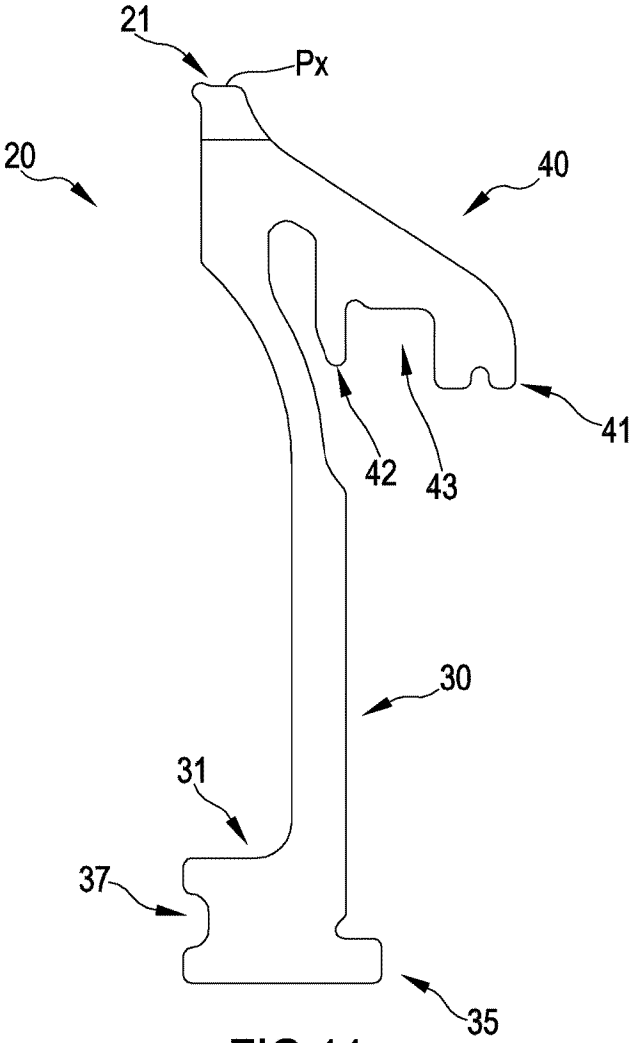
FIG. 11 is a frontal view of the lamella of FIG. 10.
Figure 10:
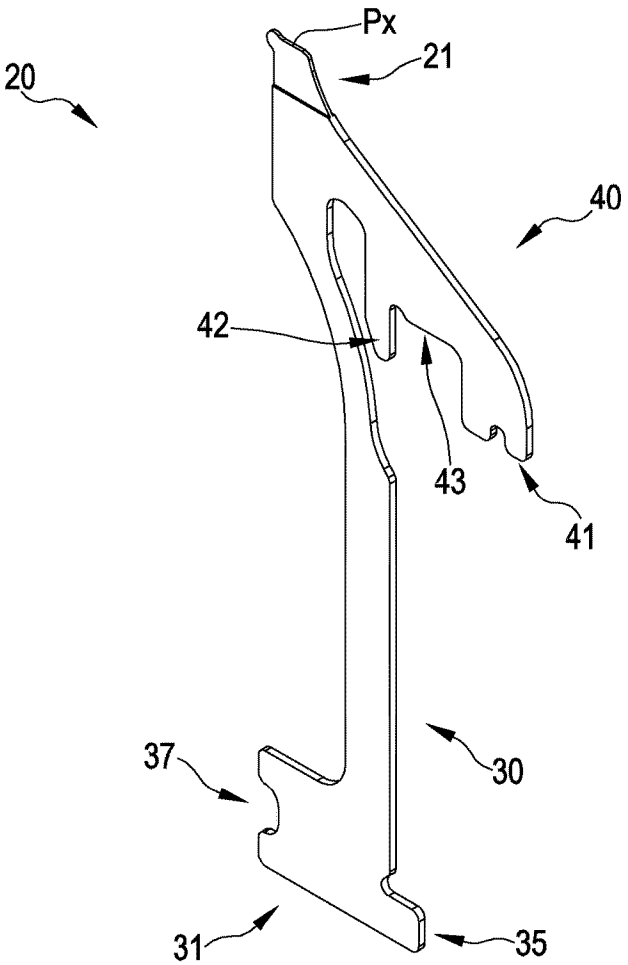
FIG. 10 is a perspective view of a possible embodiment of a defining lamella of the knitting plane according to the present invention.

A lamella according to the present invention is illustrated as a single piece, in FIGS. 10 and 11, where the elements described above can be identified. Also note, at the top portion of the lamella, i.e. at the defining portion 21 of the knitting plane (which defines the respective portion Px of the knit-forming plane) a slimming of the section (optional) on both lateral faces of the lamella 21. This slimming makes room for the thread during the descent of the needle. More in detail, each lamella superiorly receives a respective interstitch between two adjacent needles: each of the two adjacent needles descends, carrying the thread passing on the lamella, and the slimming present on the two sides of the lamella facilitates the descent of the interstitch.

The slimming can terminate at the bottom with a respective stop abutment on each of the two lateral faces.

The retaining organ 10 according to the present invention will now be described in greater detail.

Figure 13:
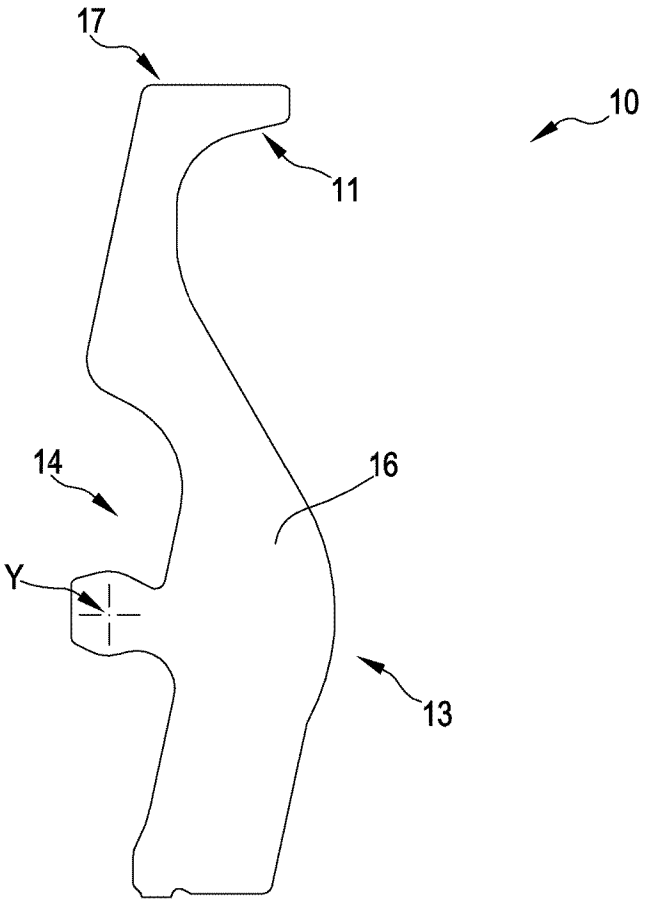
FIG. 13 is a frontal view of the retaining organ of FIG. 12.
Figure 12:
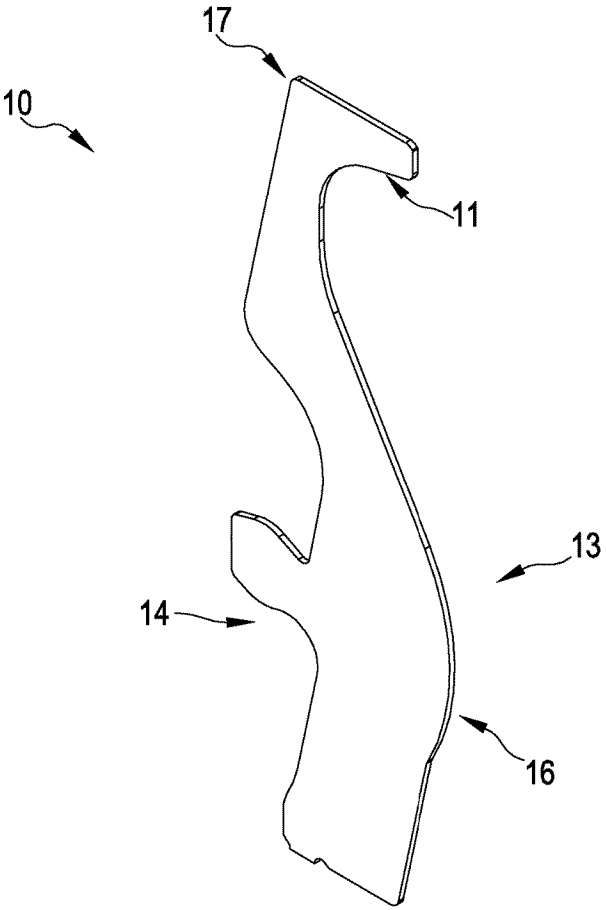
FIG. 12 is a perspective view of a possible embodiment of a retaining organ according to the present invention.

A first embodiment of such a body is illustrated by way of example in FIGS. 1 to 13, and in particular in FIGS. 12 and 13.

As can be seen from FIGS. 5 and 6, each retaining organ 10 is oscillatable, by means of the respective actuating means, in its guide half-plane B to move from the first position to the second position and vice versa. The maintaining portion 16 is preferably located in an intermediate position in the retaining organ 10, and defines an oscillating axis Y of the retaining organ 10 relatively the needle-bearing organ 3. This oscillating axis Y is oriented substantially perpendicular to the guide half-plane B in which the retaining body of the knitting lies. The retaining organ of the knitting can oscillate about the oscillating axis Y relatively to the needle-bearing organ so as to pass from the first position to the second position or vice versa.

Preferably, the maintaining portion 16 of the retaining organ exhibits a curvilinear shape, preferably a sector of a circle, on the front side 13 of the retaining organ thereof, so as to maintain a constant distance (preferably nil) from the lamella 20 during the oscillation that determines the transition from the first position to the second position and vice versa.

The portion forming the stop abutment 11 is preferably positioned at an upper end 17 of the retaining organ 10. This upper end projects beyond the knit-forming plane P (above it) and extends in the direction of the needle-bearing organ 3 so as to define, with the side thereof facing the knit-forming plane, the stop abutment 11.

The needle-bearing organ 3 preferably comprises a plurality of recesses, made in the external surface 4 and each having a respective longitudinal development, and a plurality of rods 62, each rod having a longitudinal extension and being positionable in a respective recess.

Each pair of adjacent rods 62, when positioned in the respective grooves thereof, preferably defines a stitch-forming slot 5, corresponding to a vertical space comprised between the adjacent rods. Each rod 62 occupies a vertical portion of the respective zone 15 of the needle-bearing organ 3 between two contiguous stitch-forming slots 5.

Each rod 62 preferably lies substantially on a respective guide half-plane B, on which a respective retaining organ 10 and a respective lamella 20 also lie.

Each pair of adjacent rods 62 preferably laterally guides the needle N housed in the stitch-forming slot defined by the pair of rods.

The portion of the external surface 4 of the needle-bearing organ comprised between two adjacent recesses, each housing a respective rod 62, preferably defines a bottom of the stitch-forming slot with respect to which, or on which, the needle housed in the stitch-forming slot slides vertically.

The needle-bearing organ 3 preferably comprises a recessed annular zone 70 of the external surface 4, corresponding to a narrowing of the diameter of the external surface 4, extending superiorly to the above-mentioned rods 62 and configured such as to house the retaining means 10 and the lamellae 20 so that each retaining organ-lamella pair is radially positioned on the respective guide half-plane B.

As shown by way of example in the figures, the aforementioned rods 62 preferably do not extend, in the respective half plane guide B, into the annular recessed zone 70.

The sealing portion 30 of each lamella 20 preferably extends downward from the respective defining portion 21 of the knitting plane and externally of the needle-bearing organ 3, occupying a portion of the annular recessed zone 70 up to a level of higher than the respective rod 62.

At the annular recessed zone 70, the retaining means 10 and the lamellae 20 are preferably configured such as to laterally guide the movement of the needles N housed in the stitch-forming slots 5.

The needle-bearing organ 3 preferably comprises a plurality of additional rods 65 housed in the annular recessed zone 70, alternated with the lamellae 20. Each of the additional rods 65 is mountable to the needle-bearing organ 3 in such a way as to lie on a respective half-plane of stitch-forming slot A and be radially aligned with a respective needle N (and internally thereof).

Each additional rod 65 is preferably further configured to constitute a longitudinal portion of bottom with respect to which, or on which, the needle N housed in the stitch-forming slot 5 lying on the same half-plane A slides vertically.

The rods additional 65 are preferably removably mountable, for example by gluing or by means of appropriate mounting means, to the external surface 4 and/or to the top surface 50 of the needle-bearing organ.

The actuating means of the knitting retaining organ for passage thereof from the first position to the second position and vice versa preferably comprise at least an actuating cam facing the external surface of the needle-bearing organ.

Preferably the needle-bearing organ 3 is actuable in an actuating direction substantially perpendicular to the longitudinal development of the stitch-forming slots 5 relatively to the actuating cam, and the actuating cam exhibits a profile configured to act alternately on the knitting retaining organ in two zones situated on opposite sides with respect to the oscillating axis Y so as to cause the oscillation of retaining organ about the oscillating axis relatively to the needle-bearing organ in a direction or in the opposite direction, for the passage of the retaining organ from the first position to the second position or vice versa.

Figure 9A:
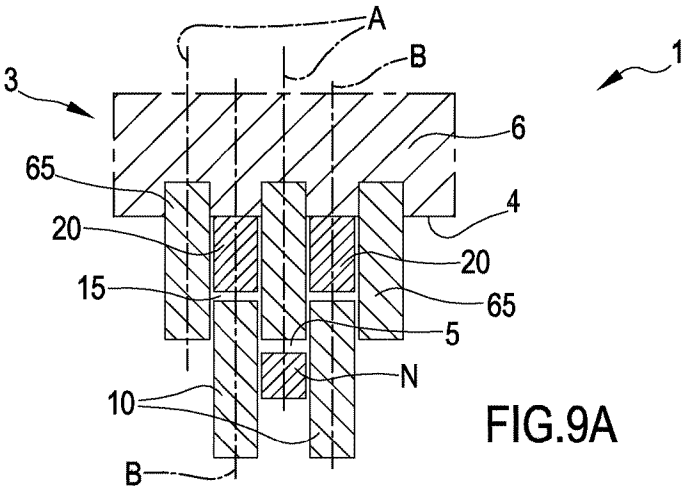
FIG. 9A is a schematic view in section of a portion of a possible embodiment of a knitting machine according to the present invention, sectioned along a horizontal plane (perpendicular to the rotation axis of the needle-bearing organ); this section is realized at a height of the needle-bearing organ such as to section the lamellae (mounted thereto) at the respective holding portion.

The embodiment described so far is schematically shown in FIG. 9A: this figure shows the reciprocal position assumed by the various components of the needle-bearing organ. In detail, the following can be observed: the body 6 of the needle-bearing organ 3, the lamellae 20, the retaining means 10, a needle N, the knit-forming half-planes A, the guide half-planes B. Also visible are the additional rods 65: note, however, that the additional rods could be in a single piece with the body 6 of the needle-bearing organ.

FIG. 9A is obtained by making a section of the textile machine along plane IX-A shown in FIG. 6.

The following is a description of a second embodiment of the retaining organ 10, illustrated by way of example in FIGS. 14, 15, 16, 17 and 18.

In this embodiment, a retaining organ 10 is solidly connected, in proximity of the rear side 14 thereof, to at least a contiguous retaining organ: the two connected retaining organs 10 are straddled on the stitch-forming slot 5 positioned between the two guide half-planes B on which the two retaining organs 10 lie. In essence, the retaining organs can be combined two by two and made solid, so as to form a pair of retaining organs, or a double retaining organ.

The two connected retaining organs are configured so as to enable a vertical sliding between them of the needle N housed in the stitch-forming slot positioned between the two guide half-planes on which the two retaining organs lie. The two inter-connected retaining organs are preferably made in a single piece.

Each organ retaining of the mesh is preferably solidly connected, in proximity of the rear side thereof, to at least a retaining organ of the contiguous stitch, the needles being slidable, each time, between two retaining organs connected to each other and between two retaining organs not connected to each other. In this situation the retaining organs are all of the double type.

The pair of combined retaining organs preferably comprises a connecting portion interposed between the organs and connecting portions of the organs other than the portions defining the respective stop abutment and different from portions laterally adjacent to the needle sliding between the two guide half-planes on which the two retaining organs of the pair lie. In other words, as can be observed from the section of FIG. 17, the pair of retaining organs exhibits a single body in the rear part and two distinct bodies (and parallel to each other) in the front part, where the two stop abutments are defined which are destined to be combined to two adjacent lamellae. In manufacturing terms, the double retaining organs can be realized as a single piece, with a thickness equal to two retaining organs plus the space comprised between them (equal to the thickness of a stitch-forming slot), on which is a recess is subsequently fashioned equal to the thickness of the stitch-forming slot and having a depth (from the front side toward the rear side) sufficient to enable the sliding of the needle housed between the two retaining bodies.

The two retaining organs connected to each other preferably partially embrace, at front sides thereof, a respective additional rod housed in the stitch-forming slot positioned between the two guide half-planes on which the two retaining organs lie.

The solid connection between two retaining organs can be implemented by realizing of a single piece, appropriately shaped and worked, as shown, or by welding two retaining organs, or by means of rivets or pins or other connecting organs of known type. In this way, pairs of organs are realised for retaining the knitting which have overall an increased thickness and thus have a greater resistance to deformation during use.

Eventually, to increase further the resistance to deformation of the retaining organs, even more than two contiguous retaining elements can be interconnected.

Figure 9B:
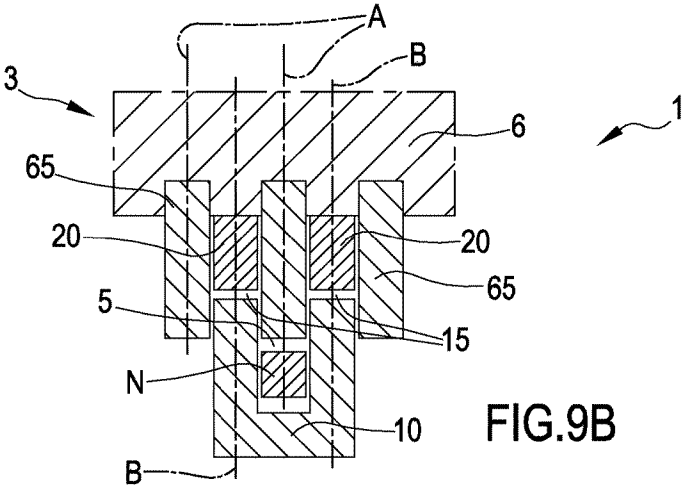
FIG. 9B is a schematic section view, alike FIG. 9A, of a portion of a further possible embodiment of a knitting machine according to the present invention.
Figure 8:
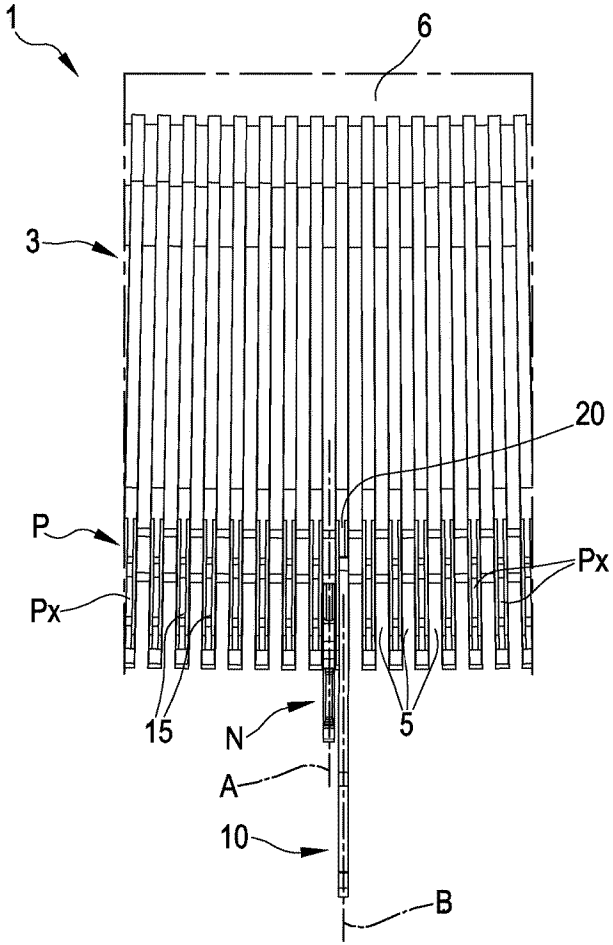
FIG. 8 is a plan view from above of the portion of knitting machine of FIG. 1, in which planes A and B are also indicated.

The embodiment described above is schematically illustrated in FIG. 9B: this figure shows the reciprocal position assumed by the various components of the needle-bearing organ. In detail, the following can be identified: the body 6 of the needle-bearing organ 3, the lamellae 20, a needle N, retaining bodies 10 of the double type which "envelop" the needle, the half-planes of stitch-forming slot A, the guide half-planes B. FIG. 9B is alike to FIG. 9A, but sectioning the textile machine illustrated in FIGS. 14 and 15.

Note that, in FIGS. 14 and 15, the lamellae 20 are illustrated by way of example in a different possible embodiment. In this embodiment, the lamellae do not include the mounting protuberance and the recessed seating.

The retaining organ 10 and the respective lamella 20 preferably have substantially the same thickness, which is substantially equal to the thickness of the rods 62 defining the stitch-forming slots or 5 to the space comprised between two stitch-forming slots.

The stitch-forming slots 5 preferably have a thickness substantially corresponding to the thickness of the needles N. The additional rods 65 preferably exhibit a thickness substantially equal to the thickness of the needles N.

The retaining organs of the present invention realise, overall, a comb, in which each retaining organ is an element of the comb interposed between two adjacent stitch-forming slots 5 to retain the interstitch present between the two adjacent needles N operating in these two stitch-forming slots, i.e. for retaining the wire interposed between, and inserted into the two adjacent needles. The comb is preferably positioned externally of the needle-bearing organ 3.

The comb can be associated with, and movably supported by, an external crown positioned off the needle-bearing organ. Preferably this external crown is solidly constrained to the needle-bearing organ.

Each of the stitch-forming slots 5 preferably has a longitudinal development parallel to the rotation axis of the needle-bearing organ 3.

The stitch-forming slots 5 are preferably developed at least at an annular upper portion of the external surface 4 of the needle-bearing organ.

Preferably each compartment training vest 5 movably accommodates a respective needle N during its motion extraction and its return motion.

Each stitch-forming slot 5 preferably extends longitudinally so as to laterally contain, for substantially its entire length, the respective needle N housed therein.

Alternatively, a plurality of sliding slots is also defined on the external surface 4 of the needle-bearing organ 3 located side by side and positioned inferiorly of, and separate from, the stitch-forming slots.

The sliding slots preferably develop at an intermediate annular portion of the external surface of the needle-bearing organ, distinct from the upper portion and distanced from the upper end of the needle-bearing organ, where the knitting plane is defined. Each sliding slot preferably develops inferiorly of a respective pair of stitch-forming slots. Each sliding slot is preferably configured to movably accommodate a respective pair of adjacent needles, which are slidably flanked internally of the sliding slot.

The sliding slot is preferably configured in such a way that the two adjacent needles contained therein are each coupled to a respective stitch-forming slot of the pair of stitch-forming slots overlying the sliding slot and combined therewith.

In a possible embodiment, not shown, each lamella and the respective rod (lying on the same half plane of driving) are integral with each other, preferably are made in one piece. In this case the lamella 20 and the corresponding rod 62 below constitute a single element.

In this embodiment, each single lamella-rod element defines both a respective portion of the knit-forming plane and a respective flank of a stitch-forming slot, which accommodates a respective needle. In other words, the single lamella-rod element extends longitudinally in such a way as to laterally guide a whole needle (cooperating with an adjacent single element to form a stitch-forming slot), and superiorly defines a respective portion of the knit-forming plane Px destined for a respective interstitch between two adjacent needles.

In this embodiment, the sealing portion of the lamella is integral with the rod: the sealing portion of the lamella extends substantially longitudinally up to the lower end of the holding portion. In this case the holding end of the sealing portion (and in particular the above-mentioned holding foot) can correspond with, and be formed at, a lower end of the rod, joined to the lamella in a single element.

In this embodiment, each stitch-forming slot (defined by flanked combined lamella—rod elements) extends longitudinally so as to laterally contain, for substantially an entire length thereof, the respective needle housed therein (there are no lower sliding slots).

The circular knitting machine of the present invention can exhibit a gauge of substantially between 14 and 90 needles per inch and/or between 32 and 60 needles per inch.

The invention as it is conceived is susceptible to numerous modifications and variants, all falling within the scope of the inventive concept, and the cited components can be replaced with other technically equivalent elements.

The present invention is applicable both on new machines and on already-existing machines, and in the latter case, as replacement of the parts of the needle-bearing organ of the traditional type.

The invention achieves important advantages. Firstly the invention enables obviating at least some of the drawbacks of the known art.

Further, the present invention enables providing a knitting machine, of the type without knockover sinkers and with mobile comb, characterized by a completely replaceable knit-forming plane. Moreover, the individual lamellae enable selectively replacing worn or damaged portions of the knit-forming plane without affecting the remaining parts of the needle-bearing organ.

The present invention therefore makes possible a knit-forming plane that is interchangeable and made up of stably-fixed lamellae that are precise and secure but at the same time removable from the needle-bearing organ.

Further, the present invention makes maintenance operations on the needle-bearing organ and the knit-forming plane simple and economical. In fact, the conformation of the lamellae enables simple and quick replacement.

Furthermore, the present invention obviates the problems related to wear of the knit-forming plane.

The present invention is also advantageously applicable to knitting machines of all gauges, and in particular solves the problems related to the knit-forming plane in high-gauge machines.

Further, the present invention enables realising knitting machines characterized by high operating reliability and a lower susceptibility to failures and malfunctions.

Also, the present invention provides a knitting machine, of a type without knockover sinkers and with a mobile comb, having an original structure, alternative and innovative compared to the known solutions.

Further, the present invention allows to have thin plates defining the knitting plane having a structure that is simple, rational and modular.

Further, the present invention enables producing knitted articles characterized by high quality and uniformity, in particular with high-gauge machines. Further, the present invention enables reducing the risk of errors in the definition of the knit-forming plane of a knitting machine.

Moreover, the knitting machine of the present invention is characterized by a competitive cost and by a simple and rational structure.

The invention claimed is:

1. A circular knitting machine (1) for knitwear, comprising:

a bearing structure;

at least a needle-bearing organ (3) or needle cylinder rotatably mounted in the bearing structure;

a plurality of needles (N) supported by the needle-bearing organ (3) and mobile so as to produce a knitted fabric;

wherein a plurality of flanked stitch-forming slots (5) is defined in an external surface (4) of the needle-bearing organ (3), each of which slots being open at least at a respective upper end and configured for movably housing at least a portion of a respective needle (N) actuable with alternating motion along the stitch-forming slot (5) with an extracting motion, by means of which the needle is extracted with a tip thereof and with a portion of a stem thereof superiorly from the needle-bearing organ through the upper end of the relative stitch-forming slot in order to operate an unloading, on the stem thereof, of a knit loop previously formed and/or to operate a collecting of the thread or the threads dispensed at a thread feeder of the machine, and with a return motion, by means of which the needle is returned with the tip thereof into the relative stitch-forming slot so as to form a new knit loop, actuating the knock over of the knit loop previously formed in order to produce a knitting stitch, wherein the needle-bearing organ (3) is superiorly provided with a knit-forming plane (P) destined to restingly receive portions of knitting situated between two contiguous needles (N) while the needles, after having collected the thread at a thread feeder of the machine, return into the respective stitch-forming slots (5) of the needle-bearing organ in order to form a new knit loop and to knock over the previously-formed knit loop, the stitch-forming slots (5) being superiorly open on a side of the needle-bearing organ (3) where the knit-forming plane (P) is defined, the knitting machine (1) comprising, in at least a part of the zones (15) of the needle-bearing organ comprised between two contiguous stitch-forming slots (5), retaining organs (10) of the knitting exhibiting each a respective portion defining an abutment shoulder (11) for the knitting, each retaining organ (10) of the knitting being mobile on command from a first position, in which it does not interfere with the knitting being formed, to a second position, in which it inserts, with the portion defining the abutment shoulder (11), between two contiguous needles (N), in a zone which superiorly faces the knit-forming plane (P), so as to retain the portion of knitting extending between two contiguous needles, opposing the dragging of the knitting along the needles during the extracting motion of the needles, the knitting machine (1) comprising, for each of the retaining organs (10) of the knitting, respective actuating means for commanding passage thereof between the first position and the second position in a coordinated way with the actuating of the contiguous needles, the machine further comprising, at least in the zones (15) comprised between the contiguous stitch-forming slots (5) provided with the retaining organ (10), lamellae (20) defining the knitting plane each exhibiting a respective portion (21) defining the knitting plane, each lamella (20) being removably mountable to the needle-bearing organ (3), in such a way as to be positioned, in the zone (15) between two contiguous stitch-forming slots (5), substantially coplanarly to the corresponding retaining organ (10) located in the zone (15), and in such a way that the respective knitting plane defining portion (21) defines a respective portion (Px) of the stitch-forming plane (P) of the needle-bearing organ (3).

2. The knitting machine (1) of claim 1, wherein each retaining organ (10) is combined with a respective lamella (20) so as to form a retaining organ-lamella pair related to a respective zone (15) of the needle-bearing organ (3) comprised between two adjacent stitch-forming slots (5), and wherein the retaining organ (10) and the lamella (20) have a thin plate conformation.

3. The knitting machine (1) of claim 1, wherein each lamella (20) is provided with a holding portion (30), configured for being externally facing the external surface (4) of the needle-bearing organ (3) in a respective zone (15) between two adjacent stitch-forming slots (5).

4. The knitting machine (1) of claim 1, wherein each of the lamellae (20) defining the knitting plane exhibits a respective mounting portion (40), configured for and predisposed to enabling single and removable mounting of the lamella (20) to the needle-bearing organ (3), and/or wherein the knitting plane defining portion (21) is interposed between and connects the mounting portion (40) and the holding portion (30), and wherein the knit-forming plane (P) and the needle-bearing organ (3) is exclusively defined by the knitting plane defining portions (21) of the lamellae (20).

5. The knitting machine (1) of claim 4, wherein the mounting portion (40) is provided with a mounting protuberance (42) distinct from the mounting end (41) and profiled so that the mounting protuberance and the mounting end define between them a mounting recess (43), the recess being complementarily-shaped with respect to a portion of a top surface (50) of the needle-bearing organ (3), such that in the mounted configuration of the lamella the mounting recess (43) superiorly surrounds the top surface portion (50) of the needle-bearing organ, the mounting end (41) being at least partially on an internal side of the needle-bearing organ and the mounting protuberance (42) being at least partially abutted on the external surface (4) of the needle-bearing organ, and wherein the mounting protuberance (42), cooperating with the mounting end (41) so as to define the mounting recess (43), is configured for preventing undesired rotations and/or translations of the respective lamella (20), when mounted to the needle-bearing organ, and/or so as to prevent the disengaging of the respective lamella from the needle-bearing organ.

6. The knitting machine (1) of claim 1, wherein the holding portion (30) of the lamella (20) terminates with a holding end (31) configured for inserting, in mounting the lamella to the needle-bearing organ, internally of a holding seating (52) of the needle-bearing organ (3), realised on the external surface (4) of the needle bearing organ, wherein the inserting of the holding end (31) in the holding seating (52) determines or contributes to the mounting of the lamella (20)

to the needle-bearing organ, and wherein the holding end (31) of the lamella (20) comprises a holding foot (35) insertable in the holding seating (52) recessing from the external surface of the needle-bearing organ, the holding foot (35) emerging from the remaining part of the holding portion of the lamella, and in a radial nearing direction to the rotation axis of the needle-bearing organ.

7. The knitting machine (1) of claim 1, wherein the inserting of the mounting end (41) in the mounting seating (51) and the inserting of the holding end (31) into the holding seating (52) determine the removable mounting of the lamella (20) to the needle-bearing organ, or wherein each lamella (20) is configured for assuming a fixed and single mounted position with respect to the needle-bearing organ (3).

8. The knitting machine (1) of claim 1, wherein the lamella (20) is conformed such that insertion of the mounting end (41) into the mounting seating (51) and the inserting of the holding end (31) into the holding seating (52) is achieved by an elastic deformation of the lamella (20), in particular of the holding portion thereof, such as to determine a snap-mounting of the lamella to the needle-bearing organ.

9. The knitting machine (1) of claim 1, comprising retaining means (80) configured for maintaining one or more lamellae (20) in the mounted position to the needle-bearing organ, preventing the lamella from translating distancingly from the needle-bearing organ and decoupling therefrom, the retaining means being positioned substantially in contact with said one or more lamellae mounted to the needle-bearing organ, in such a way as to prevent any movement of the lamella distancingly from the needle-bearing organ, and preventing demounting of the lamellae from the needle-bearing organ, and wherein the retaining means (80) are posteriorly active on the respective holding portions (30) of the one or more lamellae.

10. A lamella (20) defining a knitting plane for a needle-bearing organ (3) of a circular knitting machine (1), wherein the knitting machine (1) comprises:

a needle-bearing organ (3) or needle cylinder rotatably mounted in the bearing structure;

a plurality of needles (N) supported by the needle-bearing organ (3) and mobile so as to produce a knitted fabric;

wherein a plurality of flanked stitch-forming slots (5) is defined in an external surface (4) of the needle-bearing organ (3), each of which slots being open at least at a respective upper end and configured for movably housing at least a portion of a respective needle (N);

wherein the needle-bearing organ (3) is superiorly provided with a knit-forming plane (P) destined to restingly receive portions of knitting situated between two contiguous needles (N) while the needles, after having collected the thread at a thread feeder of the machine, return into the respective stitch-forming slots (5) of the needle-bearing organ in order to form a new knit loop and to knock over the previously-formed knit loop, the stitch-forming slots (5) being superiorly open on a side of the needle-bearing organ (3) where the knit-forming plane (P) is defined, the knitting machine (1) comprising, in at least a part of the zones (15) of the needle-bearing organ comprised between two contiguous stitch-forming slots (5), retaining organs (10) of the knitting exhibiting each a respective portion defining an abutment shoulder (11) for the knitting, each retaining organ (10) of the knitting being mobile on command from a first position, in which it does not interfere with the knitting being formed, to a second position, in which it inserts, with the portion defining the abutment shoulder (11), between two contiguous needles (N), in a zone which superiorly faces the knit-forming plane (P), so as to retain the portion of knitting extending between two contiguous needles, opposing the dragging of the knitting along the needles during the extracting motion of the needles;

wherein the lamella (20) exhibits a portion (21) defining the knitting plane and is removably mountable to the needle-bearing organ (3) in such a way as to be positioned, in a respective zone (15) between two contiguous stitch-forming slots (5) provided with a retaining organ (10), substantially coplanarly to the corresponding retaining organ (10) located in the zone (15), and in such a way that the respective knitting plane defining portion (21) defines a respective portion (Px) of the stitch-forming plane (P) of the needle-bearing organ (3).

11. The knitting machine (1) of claim 1, wherein the needle-bearing organ (3) comprises a plurality of stitch-forming slot half-planes (A) and a plurality of guide half-planes (B), distributed about the needle-bearing organ (3) and alternated with one another, in which each stitch-forming slot (5) and the respective needle (N) lie on a respective stitch-forming slot half-plane (A), and in which each zone (15) of the needle-bearing organ (3) comprised between two contiguous stitch-forming slots (5), the respective retaining organ (10) and the respective lamella (20) lie on a respective guide half-plane (B), and wherein the stitch-forming slot half-planes (A), and the guide half-planes (B) all pass through a rotation axis of the needle-bearing organ (3) and are distributed radially about the rotation axis of the needle-bearing organ.

12. The knitting machine (1) of claim 3, wherein each retaining organ (10) is provided with a front side (13), facing towards the external surface (4) of the needle-bearing organ, and a rear side (14), destined to be operatively connected to the respective actuating means, and is positioned so that the front side (13) is facing the respective lamella (20), and the lamella (20) is radially interposed, at least with the holding portion (30) thereof, between the external surface (4) of the needle-bearing organ and the retaining organ (10).

13. The knitting machine (1) of claim 1, wherein each retaining organ (10) comprises, at a front side thereof (13), a maintaining portion (16) laterally interposed between two contiguous stitch-forming slots (5) and configured for maintaining in position the respective lamella (20) mounted to the needle-bearing organ, preventing the lamella from translating, in particular radially, distancingly from the needle-bearing organ and thus being able to decouple therefrom, and wherein the maintaining portion (16) is positioned substantially in contact with the respective lamella (20) mounted to the needle-bearing organ (3) or at a distance from the lamella, mounted to the needle-bearing organ, such as to interfere with a movement of the lamella distancingly from the needle-bearing organ, both when the retaining organ (10) is in the first position, and when it is in the second position, and during passage between the first and the second position.

14. The knitting machine (1) of claim 4, wherein the mounting portion (40) has a hook conformation, and is configured for enabling mounting the lamella to the needle-bearing organ by means of a mechanical engagement, and/or wherein the mounting portion (40) of the lamella (20) terminates with a mounting end (41) configured for being at least partially complementarily-shaped to a mounting seating (51) of the needle-bearing organ (3), wherein the inserting of the mounting end (41) in the mounting seating (51) prevents distancing of the lamella (20) from the needle-bearing organ.

15. The knitting machine (1) of claim 1, wherein the holding portion (30) of the lamella (20) exhibits a determined elasticity with respect to the defining portion (21) of the knitting plane and is configured for elastically deforming during the mounting step, so that, following the inserting of the mounting end (41) in the mounting seating (51) of the needle-bearing organ, the inserting of the holding end (31) into the holding seating (52) is achieved by a snap-movement and the mounting of the lamella (20) to the needle-bearing organ (3) is removable only by applying a necessary demounting force such as to cause a counter-deformation of the holding portion which causes the decoupling of the lamella from the needle-bearing organ.

16. The knitting machine (1) of claim 1, wherein the mounting seating (51), realized on a top surface (50) or an internal surface of the needle-bearing organ (3), and the holding seating (52), realized on the external surface (4) of the needle-bearing organ (3), are orientated such that the mounting portion (40) and the holding portion (30) embrace the needle-bearing organ (3) with forces that cooperate with one another for maintaining the lamella (20) in a mounted configuration to the needle-bearing organ.

17. The knitting machine (1) of claim 1, wherein the mounting portion (40) and the holding portion (30) are, when the lamella (20) is separated from the needle-bearing organ, reciprocally positioned between them, and the mounting of the lamella requires an elastic deformation which leads to a distancing of the holding portion from the mounting portion up to complete inserting of the mounting end in the mounting seating and the holding end in the holding seating.

18. The knitting machine (1) of claim 1, wherein the lamella (20) is conformed such as to define a spring operating between a rest configuration, in which the mounting portion (40) and the holding portion (30) exhibit a reciprocal distance, and at least a stressed configuration, in which the holding portion (30) and the mounting portion (40) are distanced from one another, increasing the reciprocal distance, the distancing generating a closing force tending to return the spring into the rest configuration, the lamella (20) being configured for assuming the rest position when it is separated from the needle-bearing organ and when it is mounted to the needle-bearing organ, and so as to temporarily assume the stressed configuration when it is pressed on the needle-bearing organ so as to force snap-insertion of the mounting end in the mounting seating and the holding end in the holding seating.

19. The knitting machine (1) of claim 1, wherein the lamella (20) has an overall hook-shape, i.e. it superiorly embraces the needle-bearing organ (3) in a zone (15) between two adjacent stitch-forming slots (5), with the mounting portion (40) and the holding portion (30), positioning the knitting-plane defining portion (21) superiorly.

20. The knitting machine (1) of claim 9, wherein the retaining means (80) comprise a filiform element, preferably elastically extensible, connected to said one or more lamellae and engaging with the rear side of said one or more lamellae, the filiform element being configured for being solidly constrained to the lamellae and the needle-bearing organ, and for rotating solidly with the needle-bearing organ, and the at least a lamella exhibits a recessed seating for resting or inserting the filiform element, or wherein the retaining means (80) comprise a fixed cam, positioned externally of the needle-bearing organ, dimensioned and configured for facing an angular sector of the needle-bearing organ and engage, during the rotation of the needle-bearing organ, a plurality of adjacent lamellae comprised, instant by instant, in the angular sector.

* * * * *